US011476038B2

(12) United States Patent
Ohtsubo

(10) Patent No.: US 11,476,038 B2
(45) Date of Patent: Oct. 18, 2022

(54) INDUCTOR

(71) Applicant: Panasonic Intellectual Property Management Co., Ltd., Osaka (JP)

(72) Inventor: Mutsuyasu Ohtsubo, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 330 days.

(21) Appl. No.: 16/958,180

(22) PCT Filed: Mar. 14, 2019

(86) PCT No.: PCT/JP2019/010445
§ 371 (c)(1),
(2) Date: Jun. 26, 2020

(87) PCT Pub. No.: WO2019/208004
PCT Pub. Date: Oct. 31, 2019

(65) Prior Publication Data

US 2020/0373075 A1 Nov. 26, 2020

(30) Foreign Application Priority Data

Apr. 27, 2018 (JP) ..... JP2018-085906

(51) Int. Cl.
*H01F 27/29* (2006.01)
*H01F 27/32* (2006.01)
*H01F 41/12* (2006.01)

(52) U.S. Cl.
CPC ..... *H01F 27/29* (2013.01); *H01F 27/32* (2013.01); *H01F 41/12* (2013.01)

(58) Field of Classification Search
CPC ..... H01F 27/29; H01F 27/32; H01F 41/12
See application file for complete search history.

(56) References Cited

U.S. PATENT DOCUMENTS 8,004,379 B2 * 8/2011 Hansen ..... H01F 17/043 336/83
2004/0189430 A1 * 9/2004 Matsutani ..... H01F 27/027 336/83

(Continued)

FOREIGN PATENT DOCUMENTS

WO 2006/070544 7/2006

OTHER PUBLICATIONS

International Search Report of PCT application No. PCT/JP2019/010445 dated May 28, 2019.

*Primary Examiner* — Michael P McFadden
(74) *Attorney, Agent, or Firm* — McDermott Will & Emery LLP

(57) ABSTRACT

An inductor includes a conductor and an exterior member containing magnetic material. The conductor includes a main body embedded in the exterior member, a pair of lead-out parts connected to the main body, and a pair of electrode parts coupled to the main body and disposed outside the exterior member. The main body includes first and second conductive plates. The first conductive plate includes a pair of first end parts connected to the electrode parts, respectively, and a first central part sandwiched between the first end parts in a longitudinal direction. The second conductive plate includes a second central part connected to the first central part at a first connecting location and a pair of second end parts sandwiching the second central part therebetween in the longitudinal direction. The main body is bent at the first connecting location such that the first main surface faces the second main surface with a space in between. One of the first end parts is joined to one of the second end parts. Another of the first end parts is joined to another of the second end parts. This inductor reduces its direct current resistance and loss.

13 Claims, 16 Drawing Sheets

(56) References Cited

U.S. PATENT DOCUMENTS

| | | | | |
|---|---|---|---|---|
| 2008/0012674 | A1 | 1/2008 | Sano et al. | |
| 2014/0266539 | A1* | 9/2014 | Krishnamoorthy | H01F 27/29 336/221 |
| 2016/0133373 | A1* | 5/2016 | Orr | H01L 23/645 336/200 |
| 2019/0214181 | A1* | 7/2019 | Wang | H01F 3/14 |
| 2019/0272945 | A1* | 9/2019 | Arai | H01F 27/292 |
| 2019/0272947 | A1* | 9/2019 | Uematsu | H01F 27/2847 |
| 2020/0279688 | A1* | 9/2020 | Toyama | H01F 41/0246 |

* cited by examiner

INDUCTOR

CROSS-REFERENCE TO RELATED APPLICATIONS

This application is a U.S. national stage application of the PCT international application No. PCT/JP2019/010445 filed on Mar. 14, 2019, which claims the benefit of foreign priority of Japanese patent application No. 2018-085906 filed on Apr. 27, 2018, the contents all of which are incorporated herein by reference.

TECHNICAL FIELD

The present invention relates to an inductor for use in various electronic devices.

BACKGROUND ART

Inductors are widely used in electronic devices, such as DC-DC converters, for the purposes, such as stepping-up and stepping-down of power supply voltage and smoothing of direct current electricity.

DC-DC converters have employed drive circuits operating in higher switching frequencies. As the switching frequency increases, the inductance value of the inductor decreases accordingly.

A known example of an inductor with a low inductance value is an inductor including a core member, a flat plate-shaped conductor extending linearly and provided inside the core member, a terminal electrode provided on an outer surface of the core member and electrically connected to the conductor and also electrically connected to a mounting substrate on which the inductor is mounted. Such an inductor is disclosed in, e.g. PTL 1.

CITATION LIST

Patent Literature

PTL 1: International Publication No. 2006/070544

SUMMARY

An inductor includes a conductor and an exterior member containing magnetic material. The conductor includes a main body embedded in the exterior member, a pair of lead-out parts connected to the main body, and a pair of electrode parts coupled to the main body and disposed outside the exterior member. The main body includes first and second conductive plates. The first conductive plate includes a pair of first end parts connected to the pair of electrode parts, respectively, and a first central part sandwiched between the pair of first end parts in a longitudinal direction. The second conductive plate includes a second central part connected to the first central part at a first connecting location and a pair of second end parts sandwiching the second central part therebetween in the longitudinal direction. The main body is bent at the first connecting location such that the first main surface faces the second main surface away from the second main surface with a space in between. One of the pair of first end parts is joined to one of the pair of second end parts. Another of the pair of first end parts is joined to another of the pair of second end parts.

This inductor reduces its direct current resistance and reduce loss accordingly.

DETAIL DESCRIPTION OF PREFERRED EMBODIMENTS

Exemplary Embodiment 1

Figure 1:
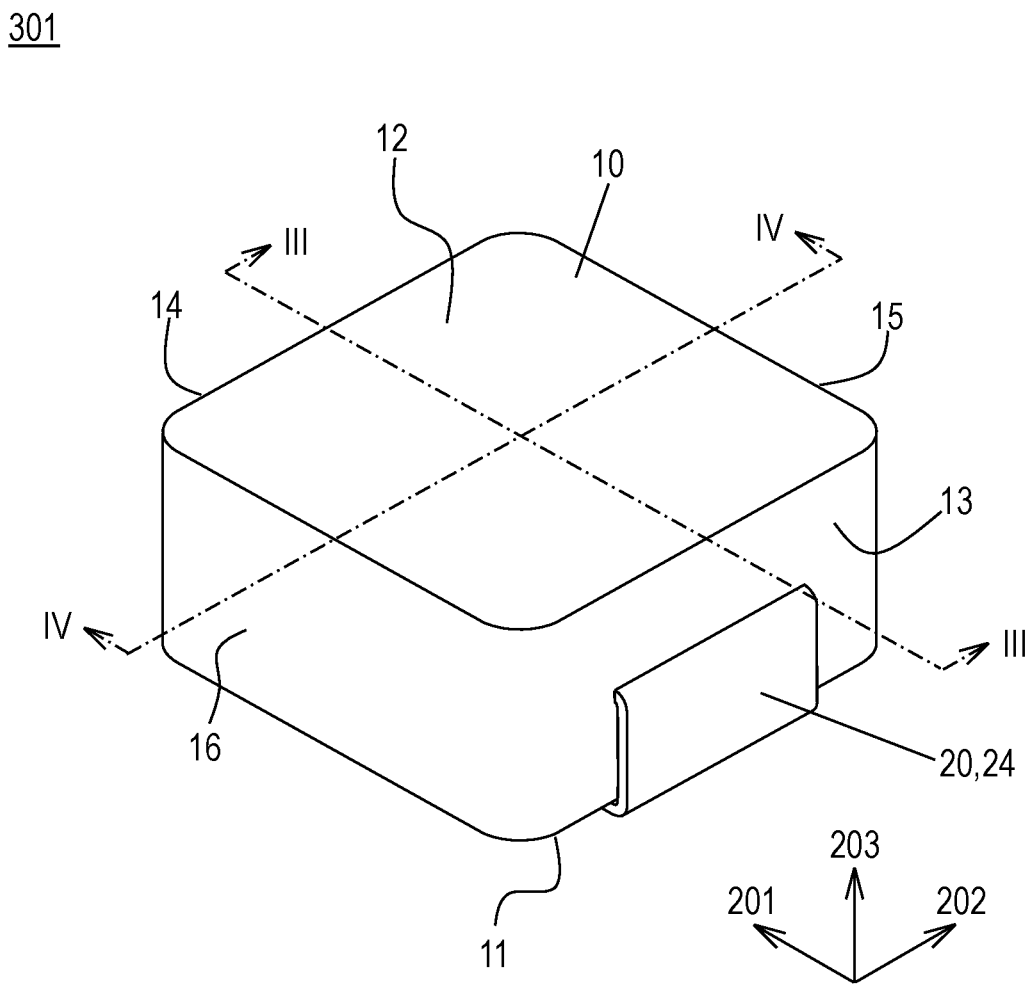
FIG. 1 is a perspective view of an inductor according to Exemplary Embodiment 1.
Figure 2:
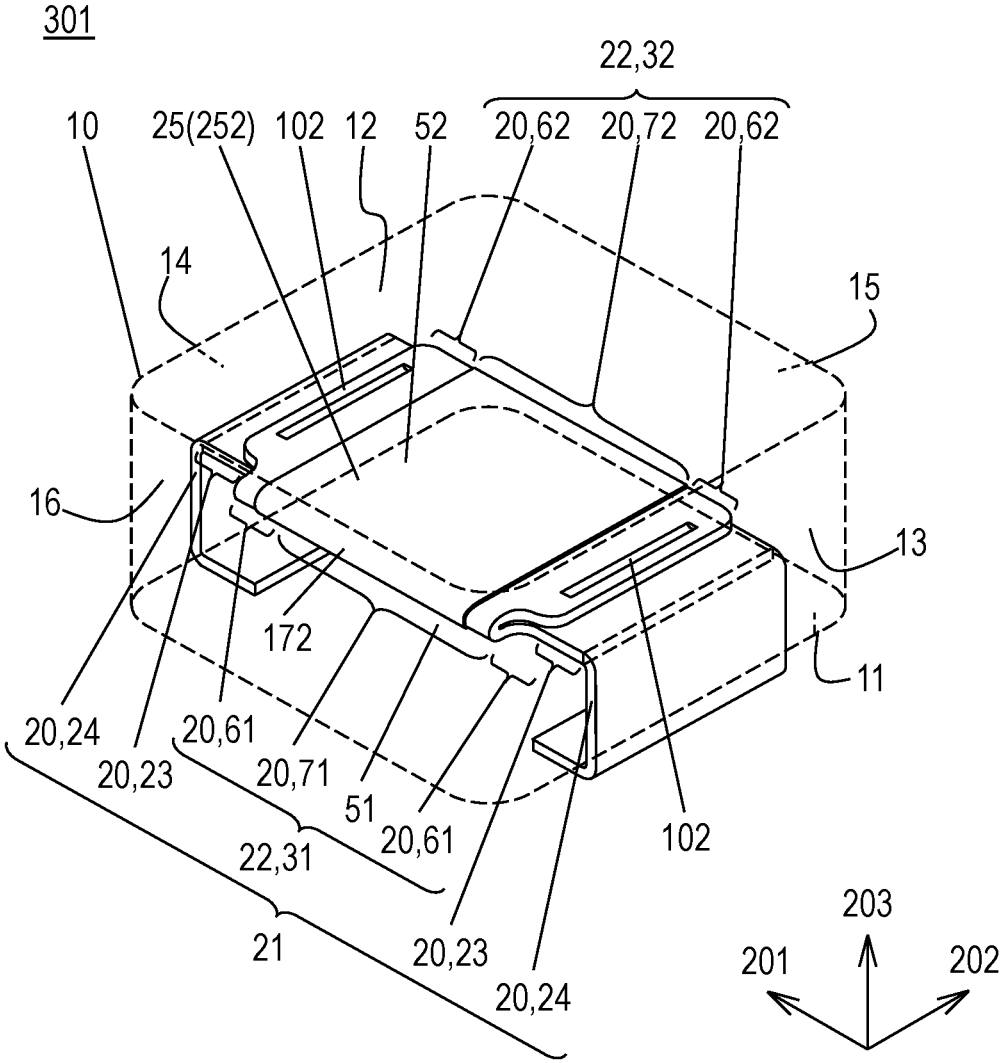
FIG. 2 is a perspective view of the inductor according to Embodiment 1.
Figure 3:
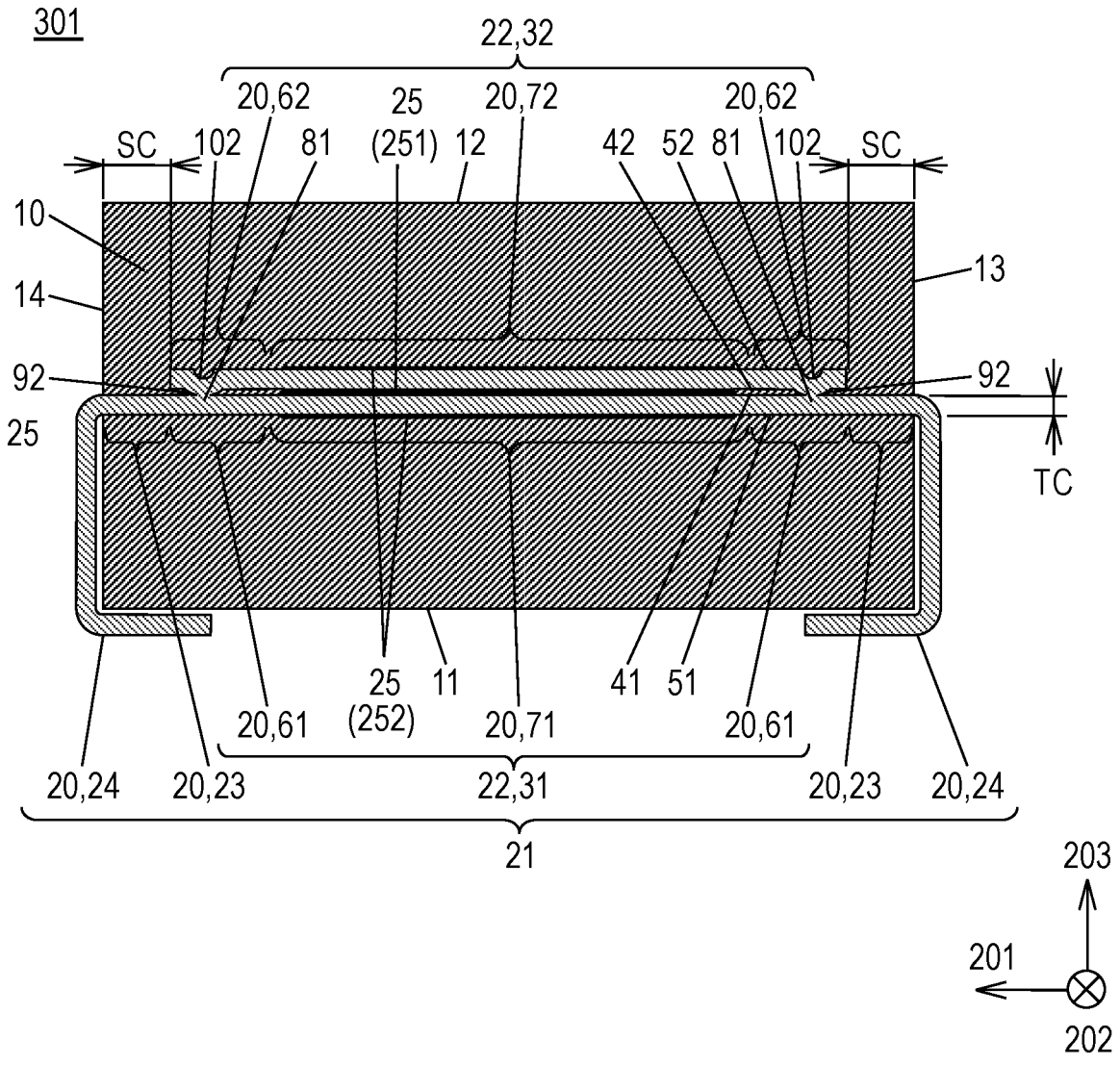
FIG. 3 is a cross-sectional view of the inductor along line III-III shown in FIG. 1.
Figure 4:
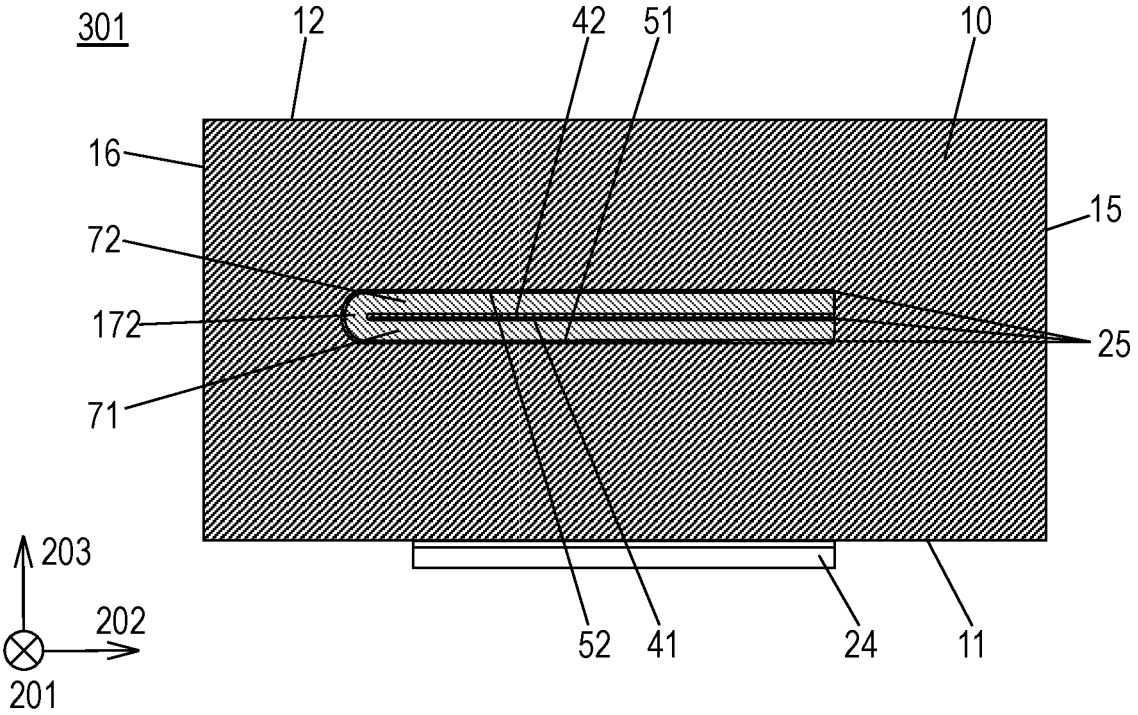
FIG. 4 is a cross-sectional view of the inductor along line IV-IV shown in FIG. 1.

FIGS. 1 and 2 are perspective views of inductor 301 according to Exemplary Embodiment 1. FIG. 3 is a cross-sectional view of inductor 301, along line III-III shown in FIG. 1. FIG. 4 is a cross-sectional view of inductor 301 along line IV-IV shown in FIG. 1. Inductor 301 includes conductor 21 made of conductive material and exterior member 10 containing magnetic material. Conductor 21 includes metal plate 20 having a thickness of 0.15 mm. FIG. 2 is a perspective view of the inductor seen through exterior member 10 in which the contour of exterior member 10 is indicated by broken lines. Inductor 301 has an inductance. Conductor 21 forms the inductance of inductor 301.

Conductor 21 includes main body 22 embedded in exterior member 10, a pair of lead-out parts 23 connected to main body 22, and a pair of electrode parts 24 which are connected to the pair of lead-out parts 23, respectively, and which are arranged outside exterior member 10. In accordance with Embodiment 1, lead-out parts 23 are embedded in exterior member 10. At least a portion of lead-out part 23 may be exposed from exterior member 10, or the entire lead-out part 23 may be exposed from exterior member 10.

As shown in FIGS. 1 and 2, main body 22 extends linearly in longitudinal direction 201 from rear to front. A direction intersecting longitudinal direction 201 and directed from rear to front along the width of main body 22 and electrode parts 24 is defined as width direction 202. In accordance with Embodiment 1, width direction 202 is perpendicular to longitudinal direction 201. A direction being perpendicular to longitudinal direction 201 and width direction 202 and extending directed bottom to top is defined as arrangement direction 203. Longitudinal direction 201, width direction 202, and arrangement direction 203 indicate the same directions throughout in all the drawings herein. The terms, such as "front", "rear", "top", and "bottom", indicating directions merely indicate relative directions determined only by relative positional relationships of structural components, such as exterior member 10 and conductor 21, of inductor 301, and indications in the drawings, and do not indicate absolute directions, such as a vertical direction.

Exterior member 10 is made of magnetic material containing magnetic material powder mixed with binder made of insulative thermosetting resin. This magnetic material is formed into granulated powder. Main body 22 and lead-out parts 23 are embedded in the granulated powder. Then, the granulated powder is press-molded, thereby forming exterior member 10.

Exterior member 10 may be formed not only by press-molding, but also by molding the magnetic material containing magnetic material powder mixed with insulative molding resin by other molding methods, such as injection molding or a transfer molding.

Exterior member 10 covers main body 22, and serves as both a magnetic core of inductor 301 and an exterior cover of inductor 301.

Exterior member 10 has bottom surface 11, top surface 12, and side surfaces 13, 14, 15, and 16. Bottom surface 11 is positioned at a bottom in arrangement direction 203. Top surface 12 is opposite to bottom surface 11. Side surface 13 is connected to bottom surface 11 and top surface 12 at a front in longitudinal direction 201. Side surface 14 is opposite to side surface 13. Side surface 15 is connected to bottom surface 11, top surface 12, and side surfaces 13 and 14 at a rear in width direction 202. Side surface 16 is connected to bottom surface 11, top surface 12, and side surfaces 13 and 14 opposite to side surface 15. In accordance with Embodiment 1, the dimensions of bottom surface 11 of exterior member 10 is 6.0 mm by 6.0 mm, the height between bottom surface 11 and top surface 12 is 3.0 mm. Exterior member 10 has substantially a rectangular parallelepiped shape.

A pair of electrode parts 24 of conductor 21 extend from the pair of lead-out parts 23 embedded in exterior member 10, respectively, and extend to be exposed from exterior member 10 from side surfaces 13 and 14 of exterior member 10 so that electrode parts 24 can be used for connection with an external circuit.

The pair of electrode parts 24 are exposed outside exterior member 10 such that width directions of electrode parts 24 are directed in width direction 202, are arranged so as to be bent from side surfaces 13 and 14 along bottom surface 11, respectively, and processed to be the pair of surface mount-type electrode parts 24, thus providing surface mount-type inductor 301.

Main body 22 is embedded in exterior member 10, extends linearly between side surface 13 and side surface 14 of exterior member 10 in longitudinal direction 201, and is connected to the pair of lead-out parts 23.

Main body 22 includes conductive plate 31 having main surface 41 and back surface 51 opposite main surface 41, conductive plate 32 having main surface 42 and back surface 52 opposite main surface 42. Main body 22 is made of metal plate 20 constituting electrode parts 24 and lead-out parts 23 unitarily.

Conductive plate 31 includes a pair of end parts 61 connected to the pair of lead-out parts 23, respectively, and central part 71 sandwiched between the pair of end parts 61 in longitudinal direction 201. Main surface 41 and back surface 51 extend from central part 71 to the pair of end parts 61.

Conductive plate 32 includes central part 72 connected to central part 71 in width direction 202 at connecting location 172, and a pair of end parts 62 sandwiching central part 72 in longitudinal direction 201 between end parts 62. Main surface 42 and back surface 52 extend from central part 72 to the pair of end parts 62. Conductive plate 31 is thus connected to conductive plate 32 at connecting location 172. Main surface 41 of conductive plate 31 is connected to main surface 42 of conductive plate 32 at connecting location 172 while back surface 51 of conductive plate 31 is connected to back surface 52 of conductive plate 32 at connecting location 172.

Main surface 41 is connected to main surface 42 while back surface 51 is connected to back surface 52.

Main body 22 is bent such that main surface 41 faces main surface 42 away from main surface 42 away from main surface 42 with a space in between so that central part 71 is connected to central part 72 at connecting location 172. The pair of end parts 61 are welded and joined to the pair of end parts 62 at a pair of joint locations 81 to share the pair of joint locations 81, respectively. In other words, one of the pair of end parts 61 is welded and joined to one of the pair of end parts 62 at one of the pair of joint locations 81 while another of the pair of end parts 61 is welded and joined to another of the pair of end parts 62 at another of the pair of joint locations 81.

The main body 22 are embedded in exterior member 10 preferably to allow distance SC between the conductive plate 32 and each of side surfaces 13 and 14 to be equal to or larger than twice the thickness TC of metal plate 20 and equal to or smaller than 10 times the thickness TC.

When electrode parts 24 are bent from side surfaces 13 and 14 along bottom surface 11 to be processed to be surface mount-type electrode parts 24, a force is applied to base portions of electrode parts 24 that are exposed from side surfaces 13 and 14 of exterior member 10. The thickness (distance SC) of exterior member 10 directly connected to the base portions ranging from 2 to 10 times the thickness TC of metal plate 20 prevents portions of exterior member 10 from having cracks therein when electrode parts 24 are processed.

In the case that distance SC between conductive plate 32 and respective side surfaces 13 and 14 is less than twice the thickness TC of metal plate 20, cracks are more likely to occur, which is undesirable. In the case that distance SC is greater than 10 times the distance SC, the size of inductor 301 will be increase, which is also undesirable. Distance SC ranges preferably from 4 to 8 times the thickness TC.

Inductor 301 according to Embodiment 1 is configured as described above.

The above-described conventional inductor employs only one sheet of flat plate shaped conductor as the conductor to be provided inside the conductor. This configuration hardly reduces the direct current resistance of the inductor and hardly reduces the loss accordingly.

In inductor 301 according to Embodiment 1, main body 22 unitarily includes conductive plates 31 and 32. This configuration increases the cross-sectional area of main body 22, accordingly reducing the direct current resistance of inductor 301 and the resistance loss of inductor 301 due to the current flowing through the inductor.

Central part 71 is connected to central part 72 at connecting location 172. Main body 22 is bent such that main surface 41 faces main surface 42 away from main surface 42 with a space in between. This configuration allows a mounting area of the inductor to be smaller than an inductor in which the cross-sectional area of main body 22 is increased by enlarging the width of metal plate 20.

One of the pair of end parts 61 connected to central part 71 shares one of the pair of joint locations 81 welded and joined thereto with one of the pair of end parts 62 connected to central part 72. Similarly, another of the pair of end parts 61 shares another of the pair of joint locations 81 welded and joined thereto with another of the pair of end parts 62. In other words, one of the pair of end parts 61 is welded and joined to one of the pair of end parts 62 at one of the pair of joint locations 81 while another of the pair of end parts 61 is welded and joined to another of the pair of end parts 62 at another of the pair of joint locations 81.

In an inductor in which central part 71 and central part 72 are connected at connecting location 172 not at the pair of joint locations 81, the electric current flowing from electrode parts 24 is likely to flow locally through central part 71 in which the path between the pair of lead-out parts 23 is shorter than central part 72, so that the effective cross-sectional area of the central parts through which the current flows is smaller than the total cross-sectional area of central part 71 and central part 72.

In contrast, inductor 301 according to Embodiment 1 includes central part 71 and central part 72 connected to each other and additionally includes the pair of joint locations 81. This configuration allows inductor 301 to flow electric current through central part 72 from end parts 61 via joint locations 81 easily, as well as through central part 71. As a result, the imbalance of current flow is reduced, and the resistance loss of inductor 301 is reduced.

Since main surface 41 of central part 71 is spaced apart from main surface 42 of central part 72, the surface area of conductor 21 does not decrease. As a result, even when the electric current flowing through conductor 21 contains high-frequency components, the inductor reduces a high-frequency loss due to the skin effect.

For inductor 301 of Embodiment 1, the welding of the pair of joint locations 81 may be carried out by various welding techniques, such as laser welding, arc welding, TIG welding, ultrasonic welding, and resistance welding.

However, when the size of inductor 301 is small and the size of conductive plates 31 and 32 is accordingly small, the adverse effects due to deformation of conductive plates 31 and 32 are significant with laser welding, arc welding, TIG welding, and ultrasonic welding. In such a case, the welding is preferably carried out by resistance welding, which is less likely to be adversely affected by the deformation.

In accordance with Embodiment 1, in cases where end parts 61 is welded to end parts 62 by resistance welding, conductive plate 32 includes a pair of protrusions 92 that protrude from main surface 42 at the pair of end parts 62, respectively, as illustrated in FIG. 3. The pair of end parts 62 have a pair of recesses 102 in back surface 52 opposite to protrusions 92, respectively. The pair of end parts 61 are preferably welded and joined to tip ends of the pair of protrusions 92, respectively.

Protrusions 92 and recesses 102 be formed preferably by press-working metal plate 20, and extend long and thin in a linear shape in width direction 202 of end parts 62 to have a length that is equal to or longer than a half of the width of each end part 62.

The tip end of each protrusion 92 and the bottom of each recess 102 preferably has a curved surface, not a flat surface. That is, the tip end of protrusion 92 is preferably curved so as to be convex in a direction in which protrusion 92 protrudes, while the bottom of recess 102 is preferably curved so as to be concave in a direction in which recess 102 sinks. As a result, even when metal plate 20 is made of material, such as a copper material, having a low electric resistivity, protrusions 92 serve as projections in resistance welding, so that resistance welding can be performed easily.

Protrusions 92 allow central part 71 and central part 72 to be spaced apart from each other reliably.

Inductor 301 according to Embodiment 1 may further include insulator 25 (251) made of insulative material provided between central part 71 and central part 72.

The insulative material may be various insulating resins, such as polyurethane resin, polyester resin, enamel resin, and polyamideimide resin. In accordance with Embodiment 1, the insulating resin may coat a portion to be between central part 71 and central part 72 at a desired thickness ranging from 5 μm to 50 μm by various techniques, such as transfer coating. The coated resin is heat-treated and cured to form insulator 25 (251).

Insulator 25 (251) prevents main surfaces 41 and 42 from contacting each other, and reliably reduces a high-frequency loss due to the skin effect.

A method of manufacturing inductor 301 according to Embodiment 1 will be described below. FIGS. 5 to 9 illustrate manufacturing processes in the method of manufacturing inductor 301.

The method of manufacturing inductor 301 according to Embodiment 1 firstly includes a metal plate preparing step.

Figure 5:
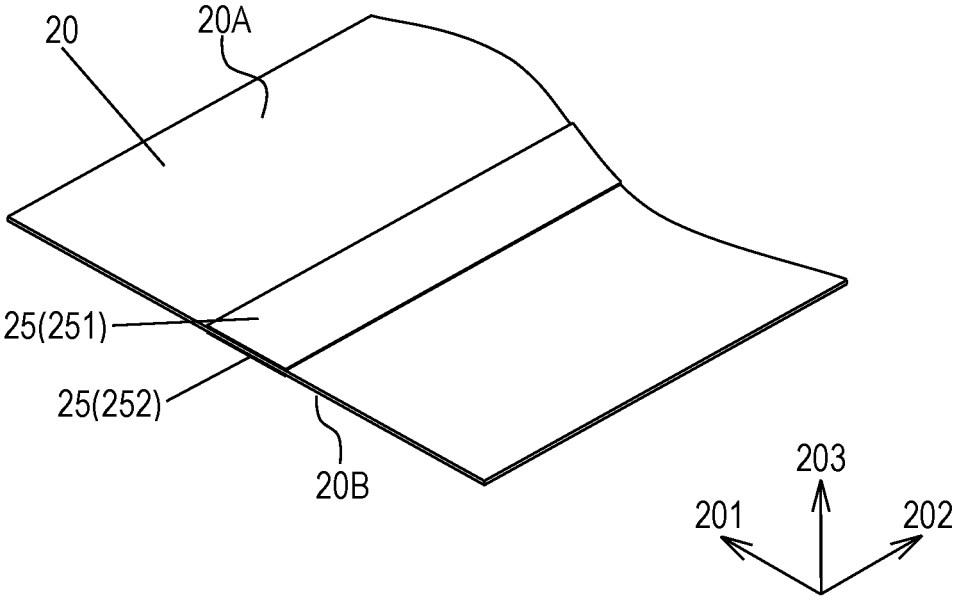
FIG. 5 illustrates a method of manufacturing the inductor according to Embodiment 1.

In this step, metal plate 20 made of copper material having a thickness of, e.g. 0.15 mm is prepared, as illustrated in FIG. 5. Metal plate 20 may be prepared as a separate piece. Plural metal plates 20 connected to each other in a belt shape may be prepared, as illustrated in FIG. 5, thereby continuously producing plural inductors 301 efficiently. Metal plate 20 has main surface 20A and back surface 20B opposite to main surface 20A. Each of main surfaces 41 and 42 connected to each other at connecting location 172 constitutes a portion of main surface 20A of metal plate 20 while each of back surfaces 51 and 52 connected to each other at connecting location 172 constitutes a portion of back surface 20B of metal plate 20.

The method of manufacturing inductor 301 next includes a metal plate processing step.

Figure 6:
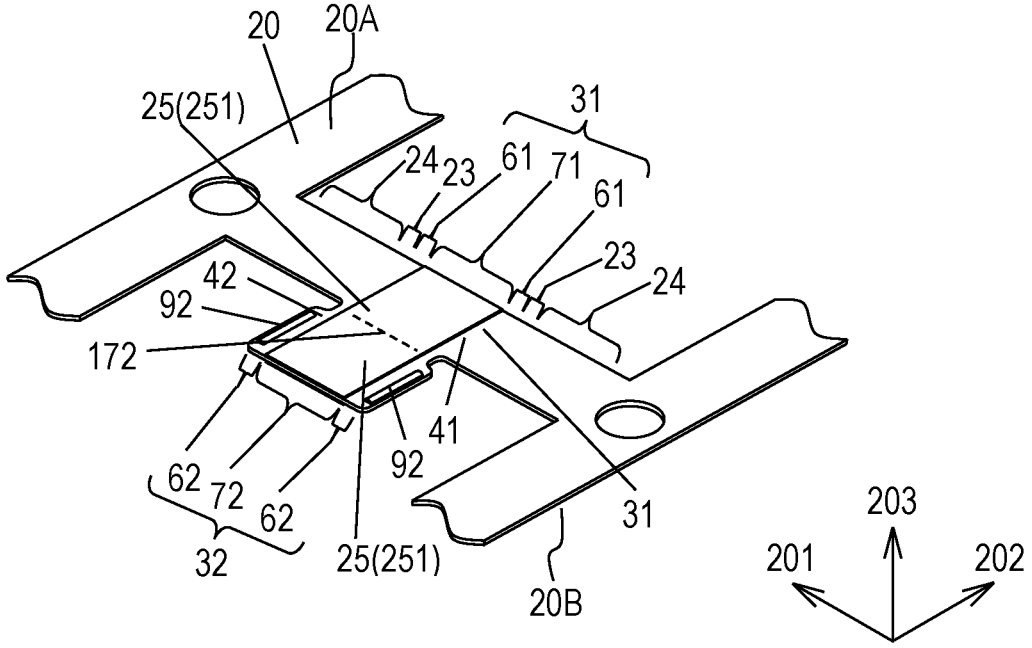
FIG. 6 illustrates the method of manufacturing the inductor according to Embodiment 1.

In this step, as illustrated in FIG. 6, metal plate 20 is punched with press machinery to form conductor 21 unitarily forming the pair of electrode parts 24, the pair of lead-out parts 23, conductive plate 31, and conductive plate 32. Main surface 41 of conductive plate 31 and main surface 42 of conductive plate 32 are formed along a single plane. Back surface 51 of conductive plate 31 and back surface 52 of conductive plate 32 are formed along a single plane.

The method of manufacturing inductor 301 according to Embodiment 1 next includes a metal plate bending step.

Figure 7:
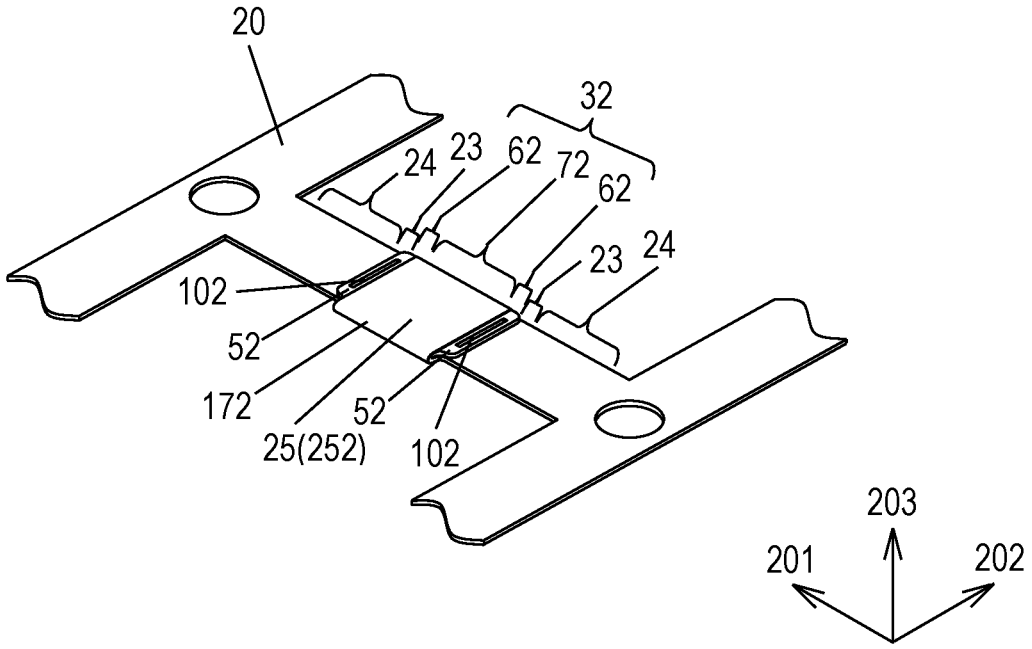
FIG. 7 illustrates the method of manufacturing the inductor according to Embodiment 1.

In this step, as illustrated in FIG. 7, metal plate 20 is bent such that main surface 41 of central part 71 of conductive plate 31 faces main surface 42 of central part 72 of conductive plate 32, shown in FIG. 6.

The method of manufacturing inductor 301 next includes a weld-joining step.

Figure 8:
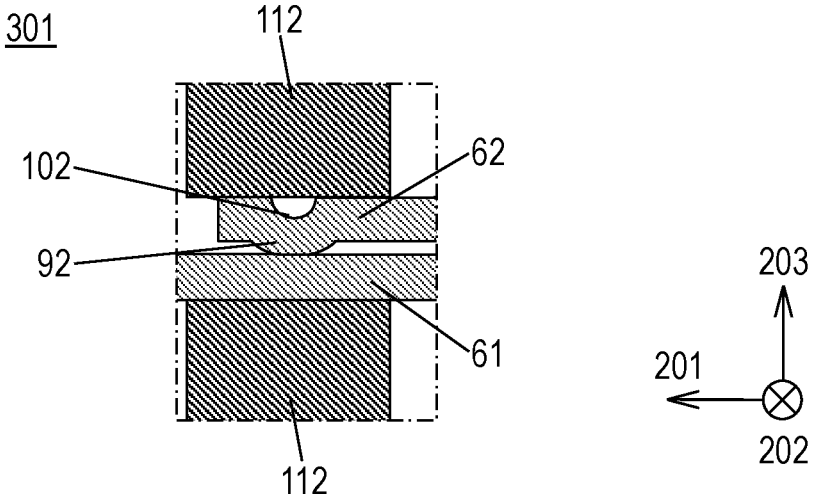
FIG. 8 illustrates the method of manufacturing the inductor according to Embodiment 1.

In this step, as illustrated in FIG. 8, end parts 61 and 62 are sandwiched by a pair of welding electrodes 112 to resistance-weld end parts 61 and 62 together, thereby forming joint location 81 at which end part 61 is welded to the tip end portion of protrusion 92, as shown in FIG. 3.

Joint location 81 is formed to provide main body 22.

The method of manufacturing inductor 301 next includes an exterior member forming step.

Figure 9:
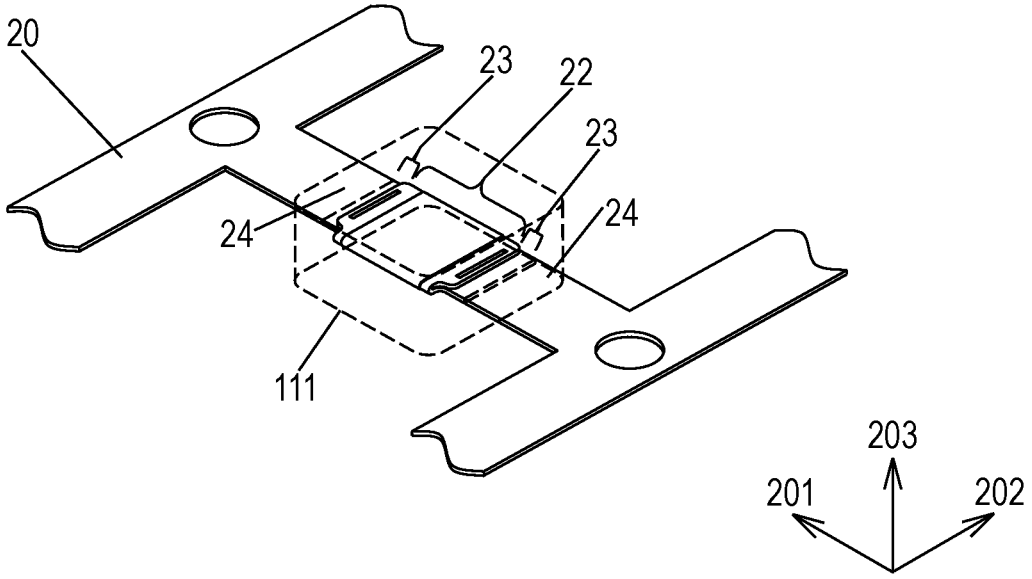
FIG. 9 illustrates the method of manufacturing the inductor according to Embodiment 1.

In this step, as illustrated in FIG. 9, lead-out parts 23 and main body 22 are placed into cavity 111 of a mold together with a magnetic material. Then, the magnetic material is molded while electrode parts 24 extend out of cavity 111 to solidify the magnetic material, thereby providing exterior member 10.

The method of manufacturing inductor 301 finally includes an electrode part processing step.

In this step, portions of metal plate 20 constituting electrode parts 24 are cut ho have a predetermined lengths, and then, are plated with solder or the like as necessary, and then are bent from side surfaces 13 and 14 of exterior member 10 toward bottom surface 11, thereby providing surface mount-type electrode parts 24.

The above processes provide inductor 301 shown in FIGS. 1 and 2.

The method of manufacturing inductor 301 according to Embodiment 1 may further include a protrusion forming step. In this step, as illustrated in FIG. 6, before the metal plate bending step, a pair of protrusions 92 protruding from main surface 42 and a pair of recesses 102 formed in back surface 52 opposite to the pair of protrusions 92 formed by press working at the pair of end parts 62.

In the weld-joining step, as illustrated in FIG. 8, end parts 61 and 62 are preferably sandwiched between the pair of welding electrodes 112 to resistance-weld end parts 61 and 62 to each other, thereby forming joint location 81 at which end part 61 is welded to the tip end of protrusion 92, as shown in FIG. 3. As a result, even when metal plate 20 is made of material, such as a copper material, having a low electric resistivity, protrusions 92 serve as the projections in resistance welding, so that resistance welding can be performed easily.

The pair of protrusions 92 reliably allow central part 71 and central part 72 to be spaced apart from each other easily.

The protrusion forming step may be performed simultaneously t the metal plate processing step as shown in FIG. 6, or may be performed after the metal plate processing step and before the metal plate bending step.

The method of manufacturing inductor 301 according to Embodiment 1 may further include an insulator forming step. In this step, before the metal plate bending step, insulator 25 (251, 252) made of insulating material is previously formed on a portion of main surface 41 or main surface 42 while main surface 41 of central part 71 and main surface 42 of central part 72 are to face each other. Specifically, insulators 251 and 252 are formed on main surface 20A and back surface 20B of metal plate 20, respectively. Insulator 251 is formed over main surfaces 41 and 42 of conductive plates 31 and 32 in central parts 71 and 72. Insulator 252 is formed over back surfaces 51 and 52 of conductive plates 31 and 32 in central parts 71 and 72.

This insulator forming step may be performed before the metal plate processing step or after the metal plate processing step. In the step shown in FIG. 5, an insulating material is applied in a strip shape on a portion at a desired position before the metal plate processing step. The insulator forming step is preferably performed before the metal plate processing step so as to form the insulator 25 more easily. Since back surfaces 51 and 52 of conductive plates 31 and 32 do not face another conductor, inductor 301 does not necessarily require insulator 252 provided on back surface 20B of metal plate 20.

A modified example of inductor 301 according to Embodiment 1 will be described below.

Figure 10:
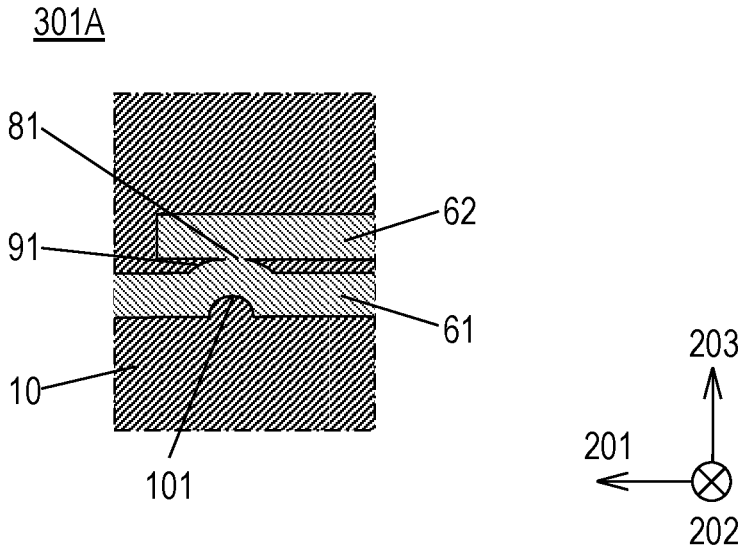
FIG. 10 is an enlarged cross-sectional view of another inductor according to Embodiment 1.

FIG. 10 is an enlarged cross-sectional view of another inductor 301A according to Embodiment 1. In FIG. 10, components identical to those of inductor 301 shown in FIGS. 1 to 9 are denoted by the same reference numerals. FIG. 10 depicts joint location 81 viewed in width direction 202 of inductor 301A.

Inductor 301A shown in FIG. 10 includes a pair of protrusions 91 protruding from main surface 41 at the pair of end parts 61 of conductive plate 31, instead of the pair of protrusions 92 provided at the pair of end parts 62 of conductive plate 32 of inductor 301.

More specifically, conductive plate 31 includes the pair of protrusions 91 protruding from main surface 41 at the pair of end parts 61, and has a pair of recesses 101 in back surface 51 opposite to protrusions 91. The pair of end parts 62 are welded and joined to the pair of protrusions 91, respectively.

The pair of protrusions 91 and the pair of recesses 101 are formed by press-working metal plate 20, and preferably extend slenderly and straight in width direction 202 of end parts 61 to have a length that is equal to or longer than a half of each end part 61 in the width direction.

The tip end of each protrusion 91 and the bottom of each recess 101 preferably have curved surfaces, similarly to protrusion 92. That is, the tip end of protrusion 91 is preferably curved to be convex in a direction in which protrusion 91 protrudes while the bottom of recess 101 is preferably curved so as to be concave in a direction in which recess 101 is sinks.

Figure 11:
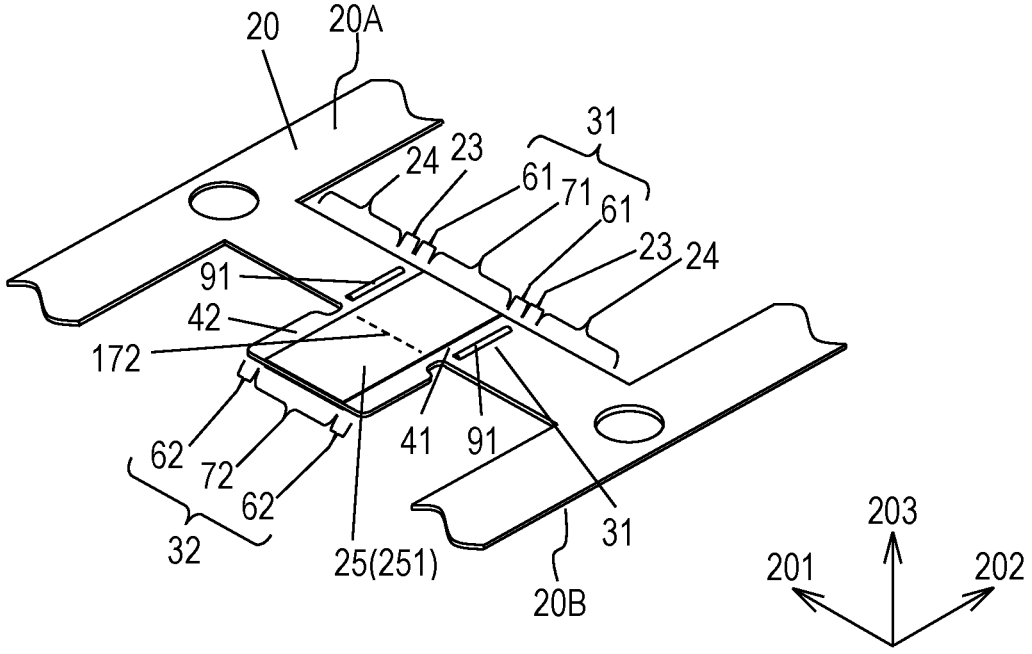
FIG. 11 illustrates a method of manufacturing the inductor shown in FIG. 10.

Differences between a method of manufacturing inductor 301A of the modified example according to Embodiment 1 and the method of manufacturing inductor 301 according to Embodiment 1 will be described below. FIG. 11 illustrates the method of manufacturing inductor 301A for illustrating the protrusion forming step.

The method of manufacturing inductor 301A of to the modified example according to Embodiment 1 further includes the protrusion forming step before the metal plate bending step. In this step, protrusions 91 and recesses 101 are formed. Protrusions 91 protrude from main surface 41 at end parts 61. Recesses 101 are provided at the back side of protrusions 91, and are provided in back surface 51.

In the weld-joining step, end parts 61 and 62 are sandwiched between a pair of welding electrodes 112 to resistance-weld end parts 61 and 62 together, thereby forming joint location 81 in which end part 62 is welded to the tip end of protrusion 91.

As described above, inductor 301 (301A) according to Embodiment 1 includes conductor 21 made of a conductive material and exterior member 10 containing magnetic material. Conductor 21 includes main body 22 embedded in exterior member 10, a pair of lead-out parts 23 connected to main body 22 and embedded in exterior member 10, and a pair of electrode parts 24 which are connected to the pair of lead-out parts 23, respectively, and which are arranged outside exterior member 10. Main body 22 includes conductive plate 31 having main surface 41 and back surface 51 opposite to main surface 41, and conductive plate 32 having main surface 42 and back surface 52 opposite to main surface 42. Conductive plate 31 includes the pair of end parts 61 respectively to the pair of lead-out parts 23, respectively, and central part 71 sandwiched between the pair of end parts 61. Main surface 41 and back surface 51 extend from central part 71 to the pair of end parts 61. Conductive plate 32 includes central part 72 connected to central part 71, and the pair of end parts 62 sandwiching central part 72 between the end parts. Main surface 42 and back surface 52 extend from central part 72 to the pair of end parts 62. Main body 22 is bent at connecting location 172 such that main surface 41 faces main surface 42 away from main surface 42 with a space in between, so that central part 71 is connected to central part 72 at connecting location 172. The pair of end parts 61 and the pair of end parts 62 share the pair of joint locations 81, respectively. One of the pair of end parts 61 is welded and joined to one of the pair of end parts 62 at one of the pair of joint locations 81. Another of the pair of end parts 61 is welded and joined to another of the pair of end parts 62 at another of the pair of joint locations 81.

In addition, conductive plate 32 may include the pair of protrusions 92 protruding from main surface 42 and have the pair of recesses 102 provided in back surface 52 at the pair of end parts 62 so that the pair of end parts 61 can be welded to the pair of protrusions 92, respectively.

Insulator 25 (251) made of insulative material may be disposed between central part 71 and central part 72.

Alternatively, instead of protrusions 92 and recesses 102, conductive plate 31 may include the pair of protrusions 91 protruding from main surface 41 and have the pair of recesses 101 provided in back surface 51 at the pair of end parts 61, so that the pair of end parts 62 can be welded to the pair of protrusions 91, respectively.

Exemplary Embodiment 2

Figure 12:
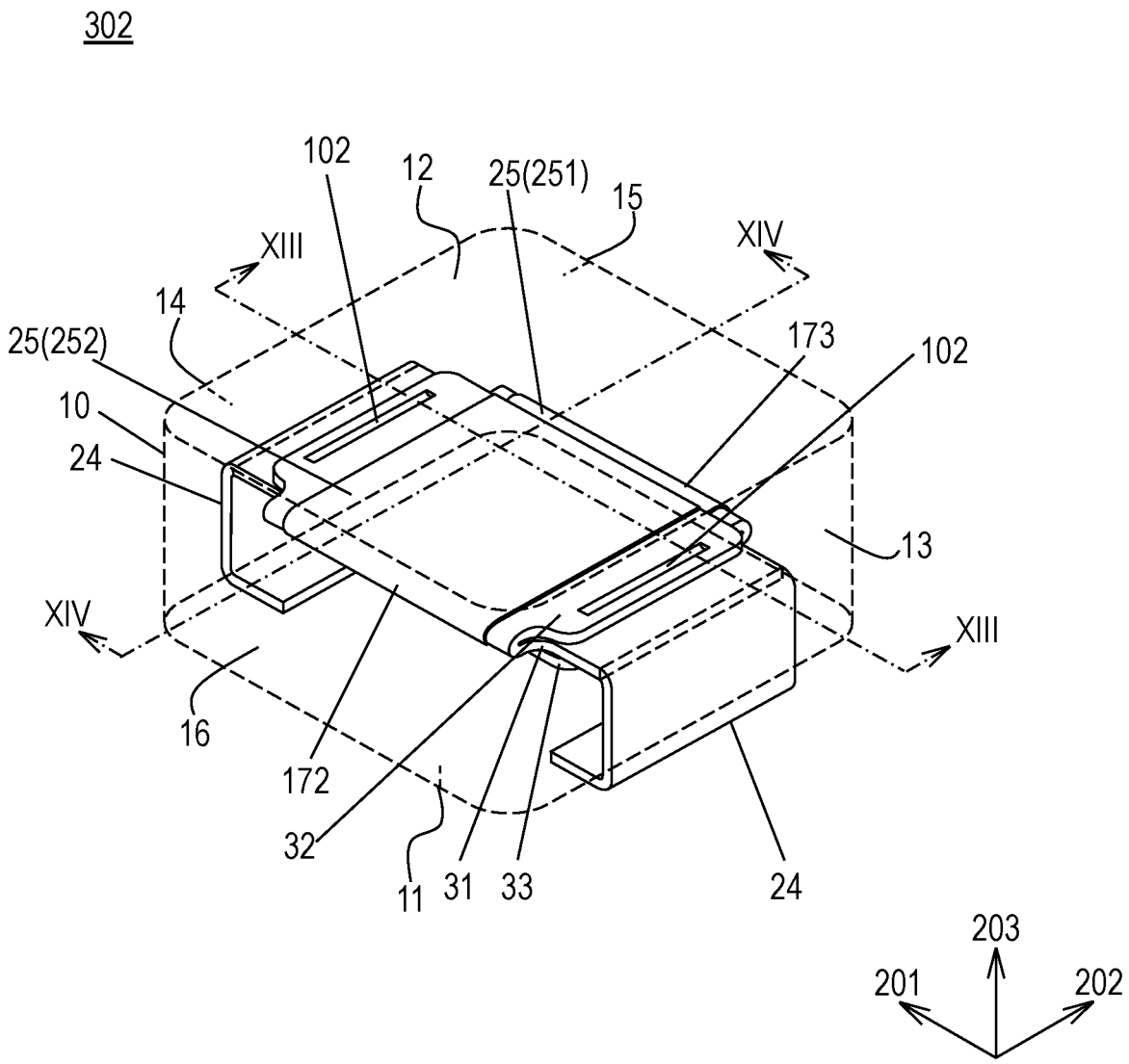
FIG. 12 is a perspective view of an inductor according to Exemplary Embodiment 2.
Figure 13:
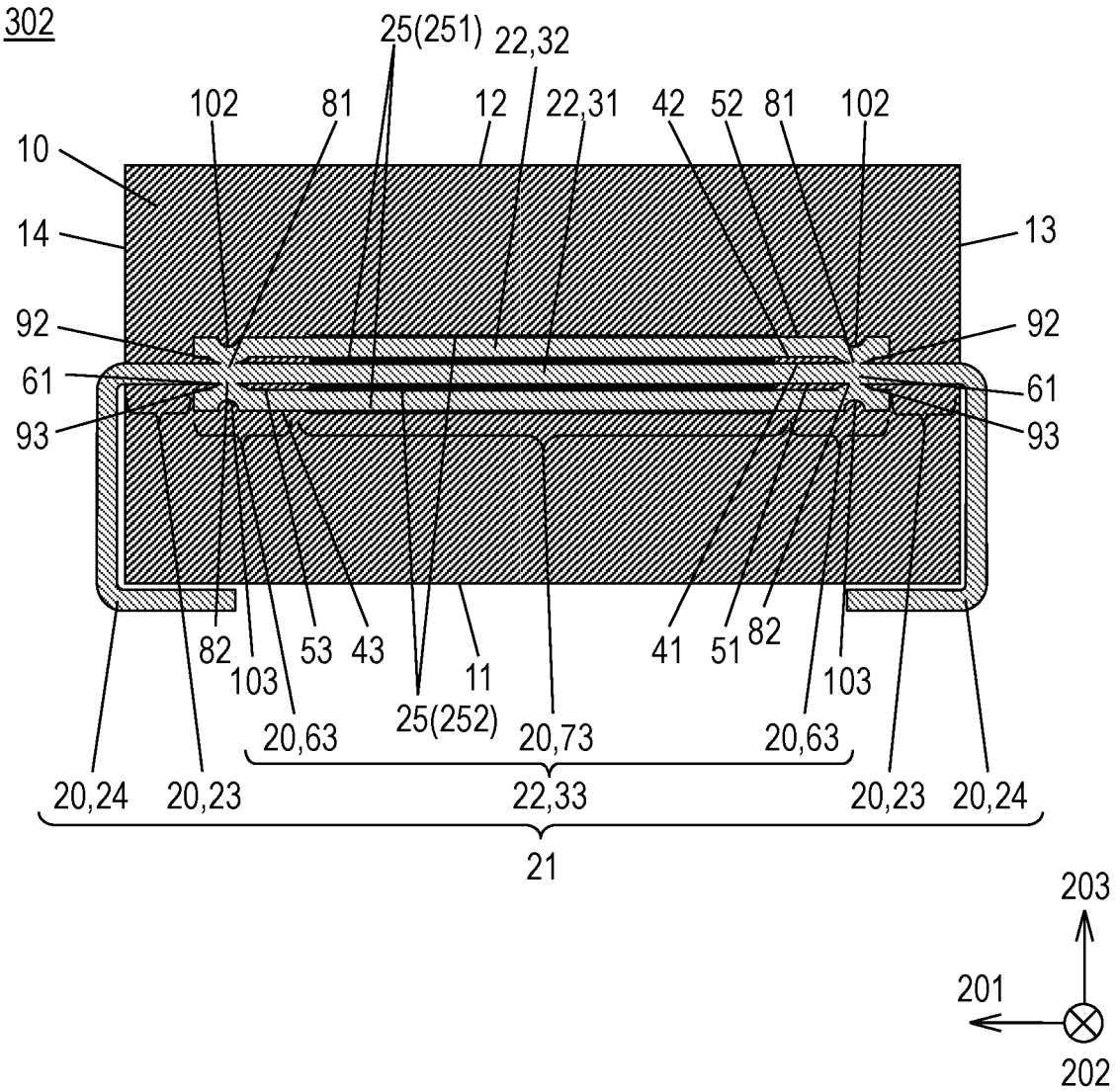
FIG. 13 is a cross-sectional view of the inductor along line XIII-XIII shown in FIG. 12.
Figure 14:
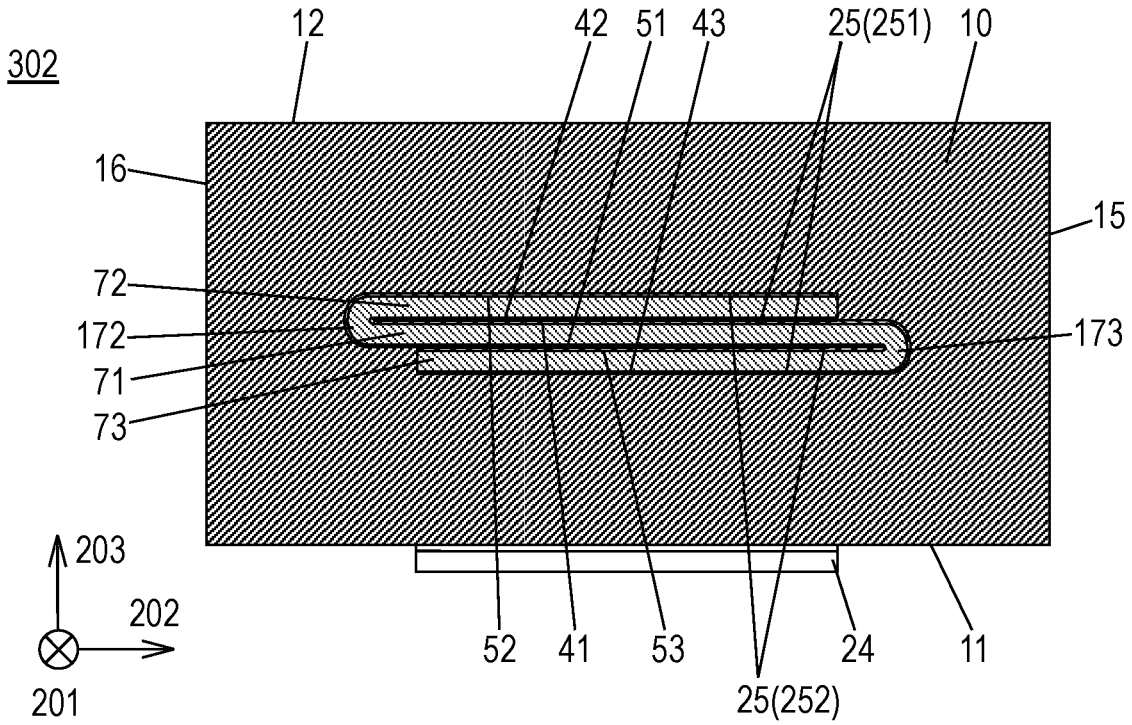
FIG. 14 is a cross-sectional view of the inductor along line XIV-XIV shown in FIG. 12.

FIG. 12 is a perspective view of inductor 302 according to Exemplary Embodiment 2. FIG. 13 is a cross-sectional view of inductor 302 along line XIII-XIII shown in FIG. 12. FIG. 14 is a cross-sectional view of inductor 302 along line XIV-XIV shown in FIG. 12. In FIGS. 12 to 14, components identical to those of inductor 301 according to Embodiment 1 shown in FIGS. 1 to 9 are denoted by the same reference numerals. FIG. 12 is a perspective view of the inductor seen through exterior member 10 in which the contour of exterior member 10 is indicated by broken lines.

A difference between inductor 302 according to Embodiment 2 and inductor 301 according to Embodiment 1 is that main body 22 further includes conductive plate 33. Repetitive description of substantially the same configurations as those of Embodiment 1 may be omitted.

As illustrated in FIGS. 12 to 14, in addition to the configuration of Embodiment 1, inductor 302 according to Embodiment 2 includes main body 22 that further includes conductive plate 33 having main surface 43 and back surface 53 opposite to main surface 43.

Conductive plate 33 includes central part 73 connected to central part 71 at connecting location 173, and a pair of end parts 63 sandwiching central part 73 between the end parts in longitudinal direction 201. Main surface 43 and back surface 53 extend from central part 73 to the pair of end parts 63. Thus, conductive plate 31 is connected to conductive plate 33 at connecting location 173. Accordingly, main surface 41 of conductive plate 31 is connected to main surface 43 of conductive plate 33 at connecting location 173 while back surface 51 of conductive plate 31 is connected to back surface 53 of conductive plate 33 at connecting location 173.

Main surface 41 is connected to main surface 43 while back surface 51 is connected to back surface 53.

Main body 22 is bent at connecting location 173 such that back surface 51 faces back surface 53 away from back surface 53 with a space in between, so that central part 71 is connected to central part 73 at connecting location 173.

The pair of end parts 61 are welded and joined to the pair of end parts 63 at a pair of joint locations 82 to share the pair of joint locations 82 respectively. In other words, one of the pair of end parts 61 is welded and joined to one of the pair of end parts 63 at one of the pair of joint locations 81, and another of the pair of end parts 61 is welded and joined to another of the pair of end parts 63 at another of the pair of joint locations 81.

Conductive plate 33 includes a pair of protrusions 93 protruding from back surface 53 to the pair of end parts 63, respectively. A pair of recesses 103 are provided in main surface 43 opposite to protrusions 93, respectively. The pair of end parts 61 are welded and joined to the tip end portions of the pair of protrusions 93, respectively.

The pair of protrusions 93 and the pair of recesses 103 are formed by press working metal plate 20. The pair of protrusions 93 and the pair of recesses 103 extend straight and slenderly in width direction 202 of end parts 63 to have a length that is equal to or longer than a half of the width of each end part 63.

The tip ends of protrusions 93 and the bottom portions of recesses 103 are processed to have curved surfaces. That is, the tip end of protrusion 93 is preferably curved so as to be convex in a direction in which protrusion 93 protrudes. The bottom of recess 103 is preferably curved so as to be concave in a direction in which recess 103 sinks.

Thus, inductor 302 of Embodiment 2 is configured as described above.

In the above-described configuration, inductor 302 according to Embodiment 2 further includes conductive plate 33 unitarily in addition to conductive plates 31 and 32 in comparison with inductor 301 according to Embodiment 1. Therefore, inductor 302 allows main body 22 to have a larger cross-sectional area and reduces the direct current resistance more than inductor 301 according to Embodiment 1. The resistance loss of inductor 302 can be reduced accordingly.

Inductor 302 further includes joint location 82 in addition to joint location 81. Therefore, inductor 302 allows electric current to flowing through central part 73 easily as well as through central part 71 and central part 72. As a result, the imbalance of current flow is reduced, and the resistance loss of inductor 302 is reduced.

Back surface 51 of central part 71 faces back surface 53 of central part 73 away from back surface 53 with a space apart in between. As a result, even when the electric current contains high-frequency components, the inductor reduces a loss in high-frequencies due to the skin effect.

In inductor 302 according to Embodiment 2, insulator 25 (252) made of insulative material may preferably be disposed between central part 71 and central part 73.

The thickness, material, and formation method of insulator 25 are the same as those of insulator 25 of Embodiment 1. This configuration reliably reduces a loss in high frequencies due to the skin effect.

In inductor 302 according to Embodiment 2, the pair of joint locations 81 preferably overlap the pair of joint locations 82 when main body 22 is viewed from the back surface 52 of conductive plate 32. This configuration provides a preferable balance in the direct current resistance and the distance from the electrode parts 24 to each of the region at which conductive plate 31 is connected to conductive plate 32 and the region at which conductive plate 31 is connected to conductive plate 33. This configuration reduces the imbalance of current flow more effectively.

Herein, the phrase "the pair of joint locations 81 overlap the pair of joint locations 82" does not necessarily mean that the sizes, shapes, and positions of joint locations 81 and joint locations 82 agree with each other, but it means that the pair of joint locations 81 have portions overlapping the pair of joint locations 82, respectively, when main body 22 is viewed from back surface 52 of conductive plate 32.

Figure 15:
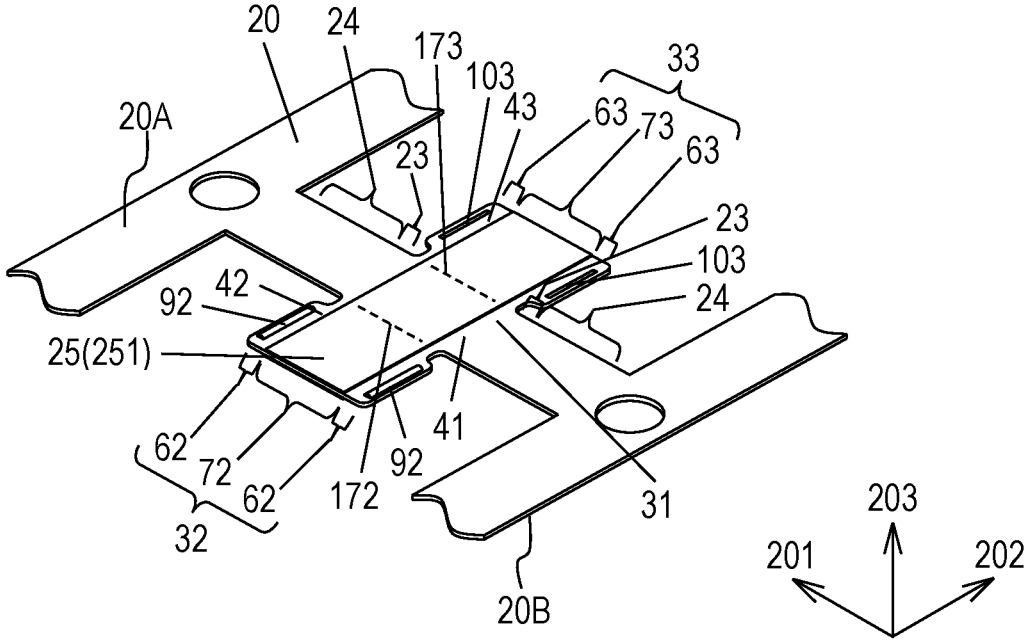
FIG. 15 illustrates a method of manufacturing the inductor according to Embodiment 2.
Figure 16:
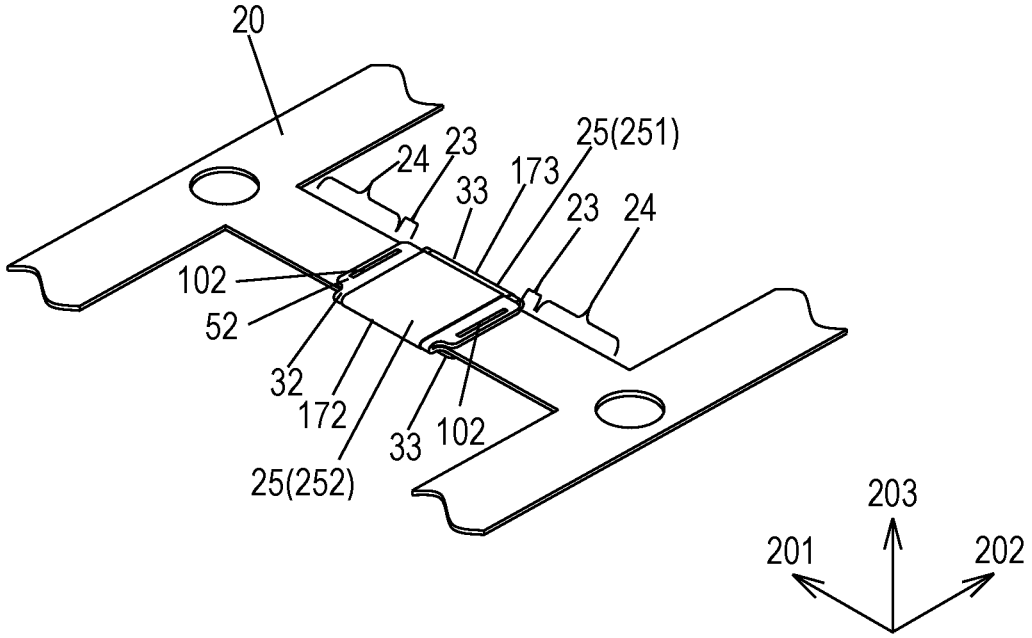
FIG. 16 illustrates the method of manufacturing the inductor according to Embodiment 2.
Figure 17:
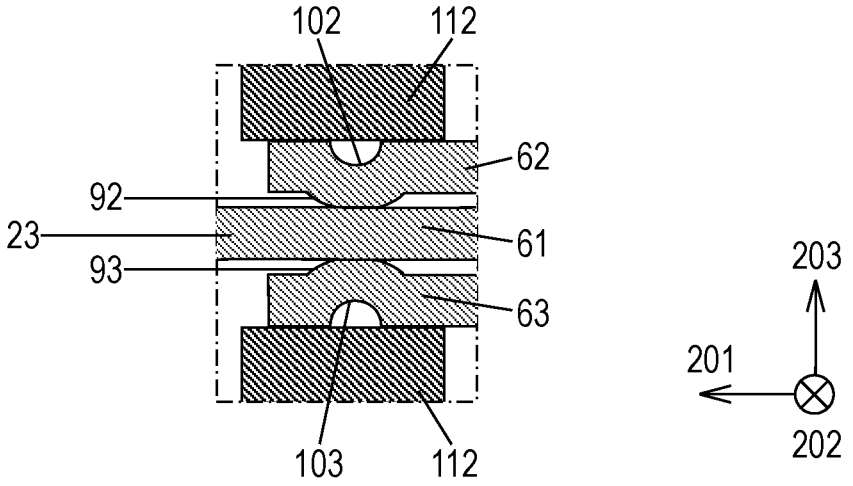
FIG. 17 illustrates the method of manufacturing the inductor according to Embodiment 2.

A method of manufacturing inductor 302 according to Embodiment 2 will be described below. FIGS. 15 to 17 illustrate the method of manufacturing inductor 302. In FIGS. 15 to 17, components identical to those of inductor 301 according to Embodiment 1 shown in FIGS. 1 to 9 are denoted by the same reference numerals. Repetitive description of substantially the same elements as those of the manufacturing method of inductor 301 of Embodiment 1 may be omitted.

Differences between the method of manufacturing inductor 302 according to Embodiment 2 and the method of manufacturing inductor 301 according to Embodiment 1 will be described below.

First, in the metal plate processing step, conductive plate 33 is prepared in addition to conductive plates 31 and 32, as illustrated in FIG. 15. Main surface 43 of conductive plate 33 and main surface 41 of conductive plate 31 are formed in a single plane. Back surface 53 of conductive plate 33 and back surface 51 of conductive plate 31 are formed in a single plane. Each of main surfaces 41 to 43 connected at connecting locations 172 and 173 constitutes a portion of main surface 20A of metal plate 20. Each of back surfaces 51 to 53 connected at connecting locations 172 and 173 constitutes a portion of back surface 20B of metal plate 20.

Next, in the protrusion forming step, a pair of protrusions 93 protruding from back surface 53 and a pair of recesses 103 provided in main surface 43 opposite to the pair of protrusions 93 are further formed at the pair of end parts 63, as illustrated in FIG. 15.

The pair of protrusions 93 and the pair of recesses 103 are formed by press working metal plate 20.

Next, in the metal plate bending step, as illustrated in FIG. 16, main body 22 is further bent at connecting location 173 such that back surface 51 faces back surface 53 away from back surface 53 with a space in between.

In this case, the pair of protrusions 92 preferably overlap the pair of protrusions 93, respectively, when main body 22 is viewed from the back surface 52 of conductive plate 32, that is, viewed in direction 203. The pair of joint locations 81 thus overlap the pair of joint locations 82, respectively, when main body 22 is viewed from the back surface 52 of conductive plate 32, that is, viewed in direction 203.

Next, in the weld-joining step, as illustrated in FIG. 17, end parts 61, 62, and 63 are sandwiched between a pair of welding electrodes 112 to resistance-weld end parts 61, 62, and 63 together, thereby simultaneously forming joint location 81 at which end part 61 is welded and joined to the tip end of protrusion 92 and joint location 82 at which end part 61 is welded and joined to the tip end of protrusion 93, as shown in FIG. 13.

Here, joint locations 81 and 82 may be resistance-welded together separately at different timings. In this case, one of the pair of welding electrodes 112 contact electrode part 24 or lead-out part 23, and another of the welding electrodes 112 contacts end part 62 to be welded at joint location 81. After that, one of the pair of welding electrodes 112 may continuously contact electrode part 24 or lead-out part 23 while another of the welding electrodes 112 may contact end part 63 to be welded at joint location 82.

This configuration allows makes the welding at joint locations 81 and 82 easier.

In the method of manufacturing inductor 302 according to Embodiment 2, an insulator forming step of forming insulator 25 made of insulating material at a portion in which central part 71 faces central part 73 may be performed before the metal plate bending step. This insulator forming step may be performed either before or after the metal plate processing step, and may be performed with the materials and formation methods for insulator 25 that have been described in Embodiment 1.

As described above, inductor 302 according to Embodiment 2 further includes main body 22 that includes conductive plate 33 having main surface 43 and back surface 53 opposite to main surface 43, in addition to Embodiment 1. Conductive plate 33 includes central part 73 connected to central part 71, and the pair of end parts 63 sandwiching central part 73 between the end parts. Main surface 43 and back surface 53 extend from central part 73 to the pair of end parts 63. Main body 22 is bent at connecting location 173 such that back surface 51 faces back surface 53 away from back surface 53 with a space in between, so that central part 71 is connected to central part 73 at connecting location 173. The pair of end parts 61 and the pair of end parts 63 share the pair of joint locations 82 at which the pair of end parts 61 are welded and joined to the pair of end parts 63, respectively. One of the pair of end parts 61 is welded and joined to one of the pair of end parts 63 at one of the pair of joint locations 82. Another of the pair of end parts 61 is welded and joined to another of the pair of end parts 63 at another of the pair of joint locations 82. Conductive plate 33 includes the pair of protrusions 93 protruding from back surface 53 at the pair of end parts 63, respectively. The pair of end parts of conductive plate 33 has the pair of recesses 103 provided in main surface 43 opposite to protrusions 93 of conductive plate 33. The pair of end parts 61 are welded and joined to the pair of protrusions 93, respectively.

Insulator 25 (252) made of insulative material may preferably be disposed between central part 71 and central part 73.

When main body 22 is viewed from the back surface 52 of conductive plate 32, the pair of joint locations 81 preferably overlap the pair of joint locations 82, respectively.

Exemplary Embodiment 3

Figure 18:
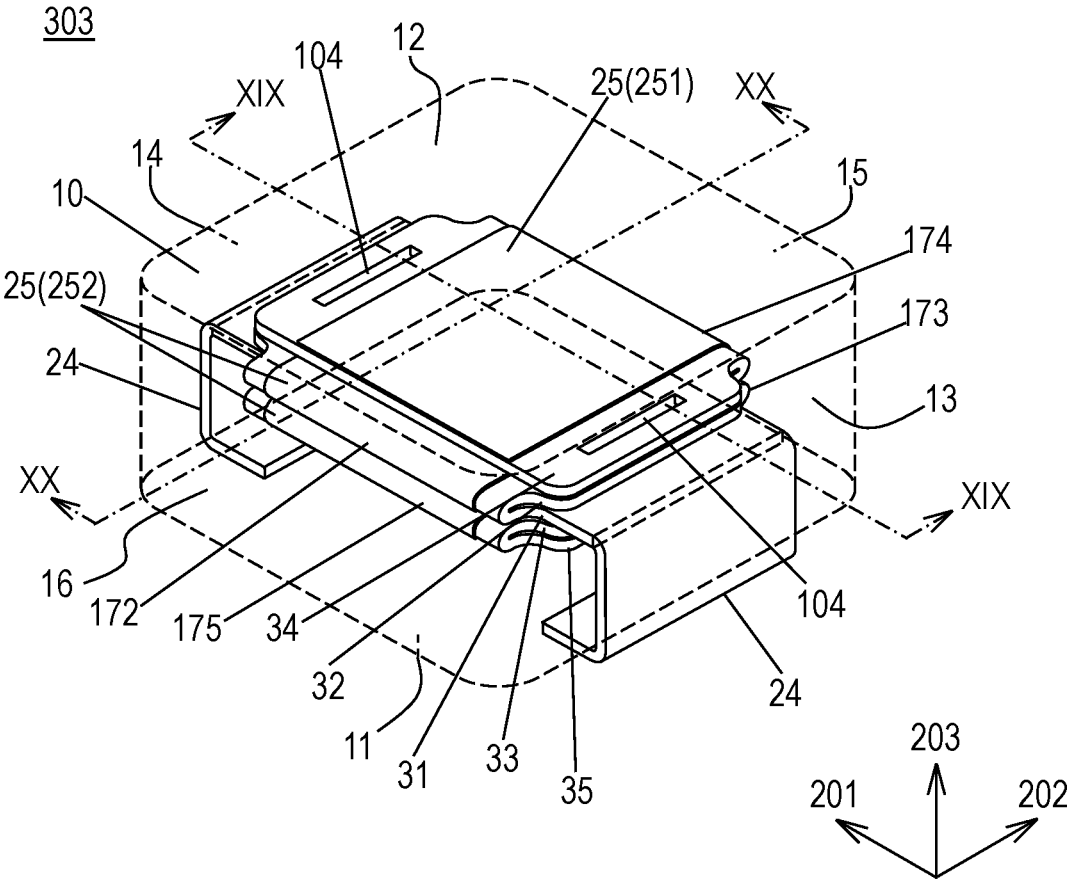
FIG. 18 is a perspective view of an inductor according to Exemplary Embodiment 3.
Figure 19:
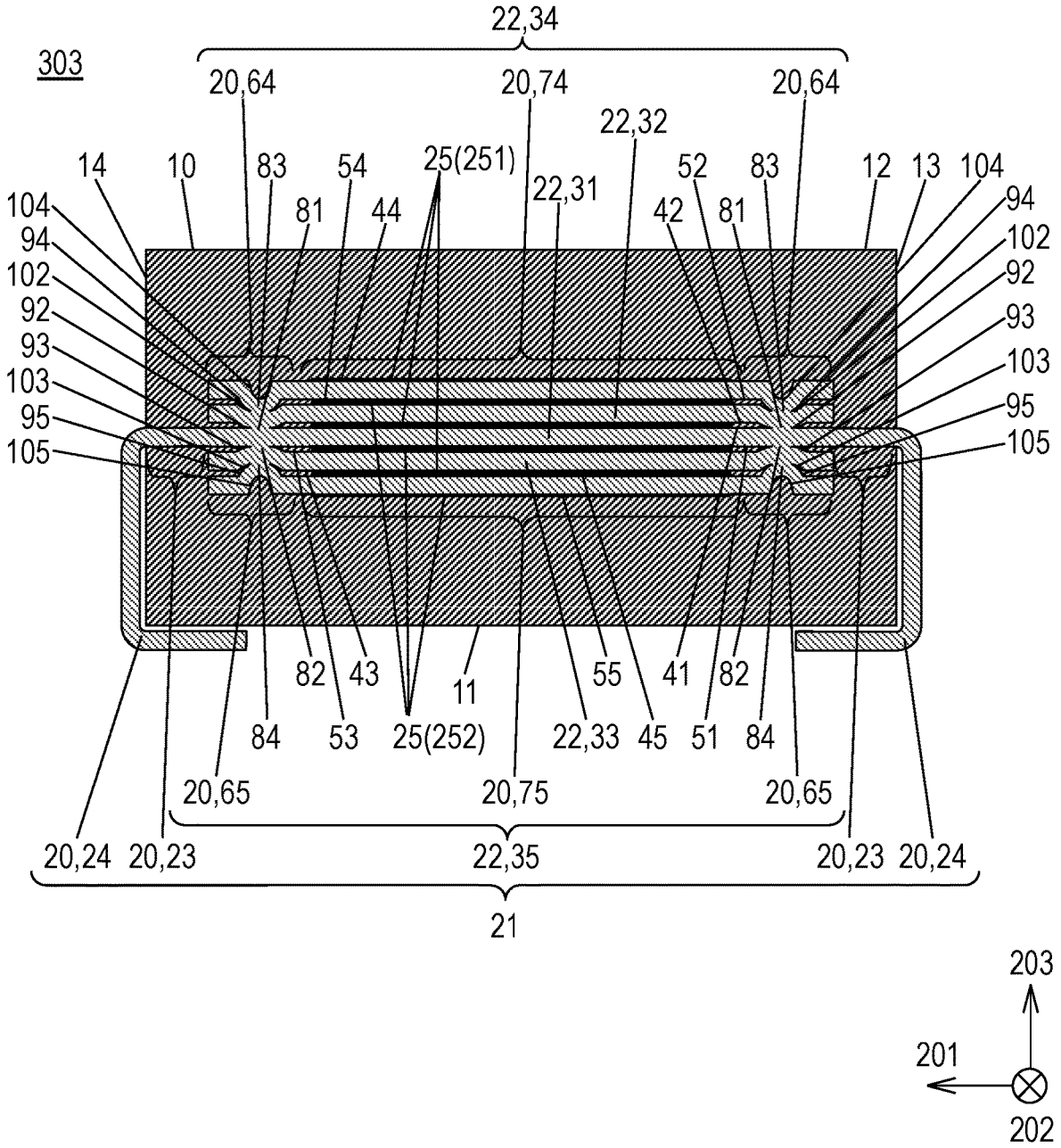
FIG. 19 is a cross-sectional view of the inductor along line XIX-XIX shown in FIG. 18.
Figure 20:
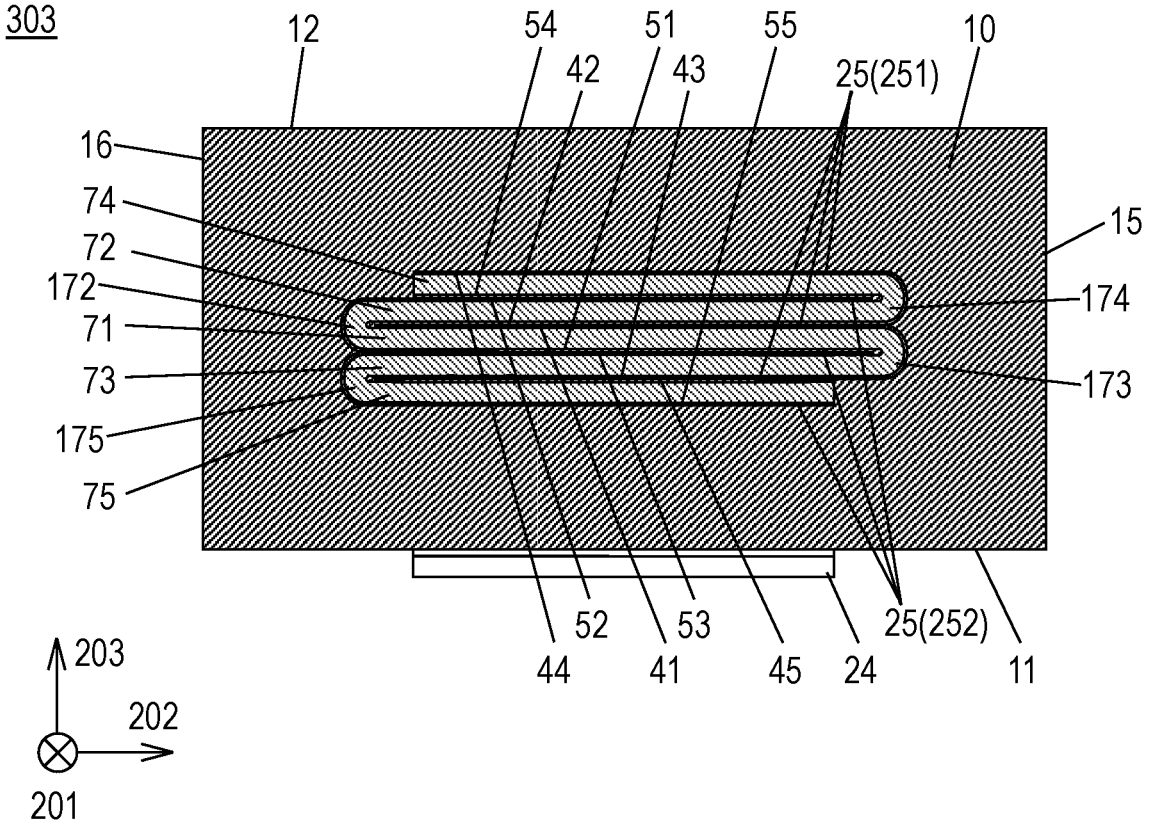
FIG. 20 is a cross-sectional view of the inductor along line XX-XX shown in FIG. 18.

FIG. 18 is a perspective view of inductor 303 according to Exemplary Embodiment 3. FIG. 19 is a cross-sectional view of inductor 303 along line XIX-XIX shown in FIG. 18. FIG. 20 is a cross-sectional view of inductor 303 along line XX-XX shown in FIG. 18. In FIGS. 18 to 20, components identical to those of inductor 302 according to Embodiment 3 shown in FIGS. 12 to 14 are denoted by the same reference numerals. FIG. 18 is a perspective view of the inductor seen through exterior member 10, in which the contour of exterior member 10 is indicated by broken lines.

A difference between inductor 303 according to Embodiment 3 and inductors 301 and 302 according to Embodiments 1 and 3 is that main body 22 further includes conductive plates 34 and 35. Repetitive description of substantially the same configurations as those of Embodiments 1 and 2 may be omitted.

As illustrated in FIGS. 18 to 20, in addition to the configurations of Embodiments 1 and 2, inductor 303 according to Embodiment 3 includes main body 22. Main body 22 further including conductive plate 34 having main surface 44 and back surface 54 opposite to main surface 44 and conductive plate 35 having main surface 45 and back surface 55 opposite to main surface 45.

Conductive plate 34 includes central part 74 connected to central part 72 at connecting location 174, and a pair of end parts 64 sandwiching central part 74 between the end parts in longitudinal direction 201. Main surface 44 and back surface 54 extend from central part 74 to the pair of end parts 64. Thus, conductive plate 32 is connected to conductive plate 34 at connecting location 174. Accordingly, main surface 42 of conductive plate 32 is connected to main surface 44 of conductive plate 34 at connecting location 174, and back surface 52 of conductive plate 32 is connected to back surface 54 of conductive plate 34 at connecting location 174. Conductive plate 33 is connected to conductive plate 35 at connecting location 175. Accordingly, main surface 43 of conductive plate 33 is connected to main surface 45 of conductive plate 35 at connecting location 175, and back surface 53 of conductive plate 33 is connected to back surface 55 of conductive plate 35 at connecting location 175.

Main surface 42 is connected to main surface 44, and back surface 52 is connected to back surface 54.

Main body 22 is bent such that back surface 52 faces back surface 54 with space in between, so that central part 72 is connected to central part 74 at connecting location 174.

The pair of end parts 62 are welded and joined to the pair of end parts 64 at a pair of joint locations 83 to share the pair of joint locations 83, respectively. In other words, one of the pair of end parts 62 is welded and joined to one of the pair of end parts 64 at one of the pair of joint locations 83 while another of the pair of end parts 62 is welded and joined to another of the pair of end parts 64 at another of the pair of joint locations 83.

Conductive plate 34 includes a pair of protrusions 94 protruding from back surface 54 at the pair of end parts 64, respectively. Conductive plate 34 has a pair of recesses 104 provided in main surface 44 opposite to protrusions 94, respectively. The pair of end parts 62 are welded and joined to the tip end portions of the pair of protrusions 94, respectively.

Conductive plate 35 includes central part 75 connected to central part 73 at connecting location 175, and a pair of end parts 65 sandwiching central part 75 between the end parts in longitudinal direction 201. Main surface 45 and back surface 55 extend from central part 75 to the pair of end parts 65.

Main surface 43 is connected to main surface 45 while back surface 53 is connected to back surface 55.

Main body 22 is bent at connecting location 175 such that main surface 43 faces main surface 45 away from main surface 45 with a space in between, so that central part 73 is connected to central part 75 at connecting location 175.

The pair of end parts 63 are welded and joined to the pair of end parts 65 at a pair of joint locations 84 to share the pair of joint locations 84, respectively. In other words, one of the pair of end parts 63 is welded and joined to one of the pair of end parts 65 at one of the pair of joint locations 84 while another one the pair of end parts 63 is welded and joined to another of the pair of end parts 65 at another of the pair of joint locations 84.

Conductive plate 35 includes a pair of protrusions 95 protruding from main surface 45 at the pair of end parts 65. Conductive plate 35 has a pair of recesses 105 provided in back surface 55 positioned opposite to protrusions 95. The pair of end parts 63 are welded and joined to the tip ends of the pair of protrusions 95, respectively.

Protrusions 94 and 95 and recesses 104 and 105 are formed by press working metal plate 20.

Protrusions 94 and 95 extend straight and slenderly in width direction 202 of end parts 64 and 65 to have a length that is equal to or longer than a half of the width dimension of each of end parts 64 and 65. The length of protrusions 94 and 95 in width direction 202 is shorter than the length of recesses 102 and 103 in width direction 202.

The tip ends of protrusions 94 and 95 and the bottoms of recesses 104 and 105 are processed to have curved shapes having curvature portions. That is, the tip ends of protrusions 94 and 95 are curved to be convex in a direction in which protrusions 94 and 95 protrude, and the bottoms of recesses 104 and 105 are curved to be concave in a direction in which recesses 104 and 105 sink.

Thus, inductor 303 according to Embodiment 1 is configured as described above.

In the above-described configuration, inductor 303 according to Embodiment 3 includes main body 22 further including conductive plates 34 and 35 in addition to conductive plates 31, 32, and 33, thereby allowing the cross-sectional area of main body 22 to be even greater than that of Embodiments 1 and 2. As a result, inductor 303 further reduces the direct current resistance more than to inductors 301 and 302 according to Embodiments 1 and 2. The resistance loss of inductor 303 is further reduced.

Inductor 303 includes joint locations 83 and 84 in addition to joint locations 81 and 82. Therefore, inductor 303 allows electric current to flow through conductive plates 34 and 35 easily as well as through conductive plates 31, 32, and 33. As a result, an imbalance of current flow is reduced, and the resistance loss of inductor 303 is reduced.

Central part 72 faces central part 74 away from central part 74 with a space in between so that back surface 52 faces back surface 54 away from back surface 54 with a space in between, and main surface 43 faces main surface 45 away from main surface 45 with a space in between so that central part 73 faces central part 75 away from central part 75 with a space in between. As a result, even when the electric current flowing through the conductor contains high-frequency components, a loss in high frequencies due to the skin effect is reduced.

In inductor 303 according to Embodiment 3, insulator 25 (252) made of insulative material may be preferably disposed between central part 72 and central part 74. Insulator 25 (251) made of insulative material may be disposed between central part 73 and central part 75. Insulator 251 is formed over main surfaces 41 to 45 of conductive plates 31 to 35 in central parts 71 to 75. Insulator 252 is formed over back surfaces 51 to 55 of conductive plates 31 to 35 in central parts 71 to 75. The thickness dimension, material, and the like of insulator 25 are the same as those of insulator 25 described in Embodiments 1 and 2. As a result, a loss in high frequencies due to the skin effect is more reliably reduced.

In inductor 303 of Embodiment 3, the pair of joint locations 81, the pair of joint locations 82, the pair of joint locations 83, and the pair of joint locations 84 preferably overlap each other, respectively, when main body 22 is viewed from main surface 44 of conductive plate 34, that is, when viewed in a direction perpendicular to main surface 44. More specifically, one of the pair of joint locations 81, one of the pair of joint locations 82, one of the pair of joint locations 83, and one of the pair of joint locations 84 preferably overlap with each other, and another of the pair of joint locations 81, another of the pair of joint locations 82, another of the pair of joint locations 83, and another of the pair of joint locations 84 preferably overlap each other. This configuration provides a preferable balance in the direct current resistance and the distance from electrode parts 24 to each of the region at which conductive plate 34 is connected to conductive plate 32 and the region at which conductive plate 35 is connected to conductive plate 33. Therefore, the imbalance of flowing current more effectively is reduced.

Herein, the phrase "the pair of joint locations 81, the pair of joint locations 82, the pair of joint locations 83, and the pair of joint locations 84 overlap with each other" does not necessarily mean that the sizes, shapes, and positions of joint locations 81, 82, 83, and 84 agree with each other, but it means that joint locations 81, 82, 83, and 84 have portions overlapping with each other when main body 22 is viewed from main surface 44 of conductive plate 34.

In inductor 303 according to Embodiment 3, in the pair of joint locations 83, the tip ends of the pair of protrusions 94 are fitted into the pair of recesses 102, respectively, so that the tip ends of the pair of protrusions 94 are welded and joined to the bottom portions of the pair of recesses 102, respectively. In the pair of joint locations 84, the tip ends of the pair of protrusions 95 are preferably fitted into the pair of recesses 103, respectively, so that the tip ends of the pair of protrusions 95 are welded and joined to the bottom portions of the pair of recesses 103, respectively.

This configuration allows joint locations 81, 82, 83, and 84 to overlap each other more reliably when main body 22 is viewed from main surface 44 of conductive plate 34. This configuration provides a preferable balance in the direct current resistance and the distance from electrode parts 24 to each of the regions at which conductive plates 31, 32, 33, 34, and 35 are connected to each other. Therefore, the imbalance of current flow is reduced more effectively.

Figure 21:
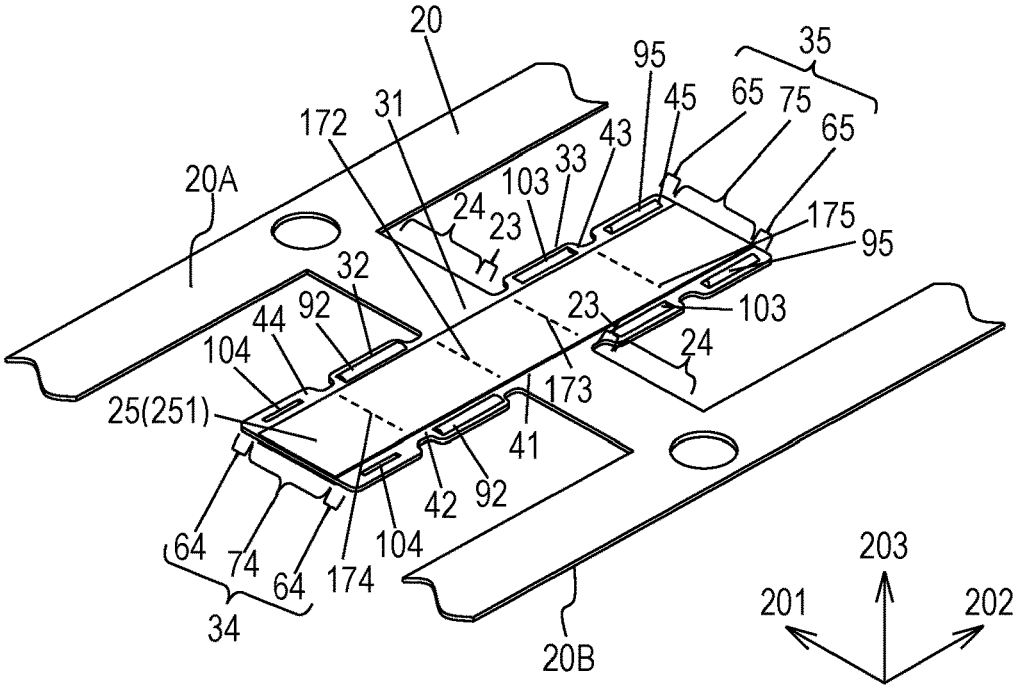
FIG. 21 illustrates a method of manufacturing the inductor according to Embodiment 3.
Figure 22:
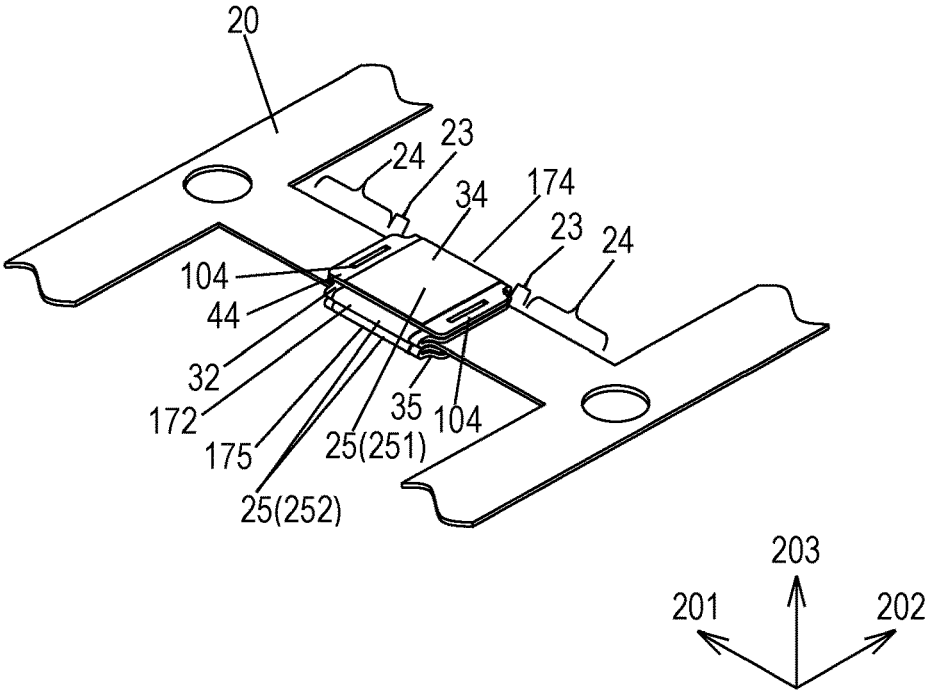
FIG. 22 illustrates the method of manufacturing the inductor according to Embodiment 3.
Figure 23:
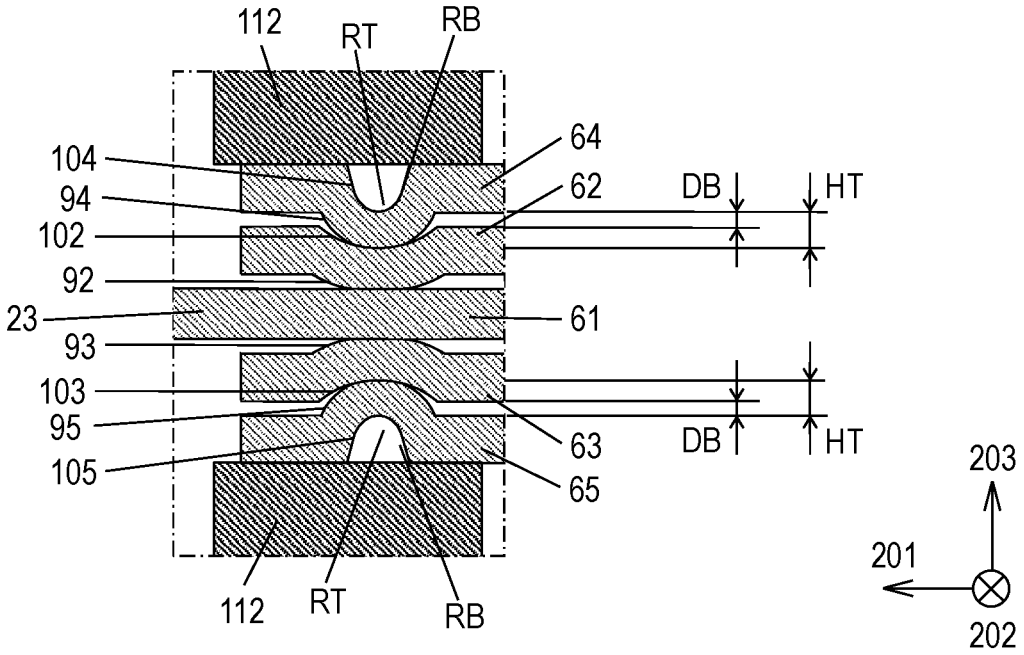
FIG. 23 illustrates the method of manufacturing the inductor according to Embodiment 3.

A method of manufacturing inductor 303 according to Embodiment 3 will be described below. FIGS. 21 to 23 illustrates the method of manufacturing inductor 303. Repetitive description of substantially the same elements as those of the methods of manufacturing inductors 301 and 302 of Embodiments 1 and 2 as shown in FIGS. 1 to 17 may be omitted when referring to FIGS. 21 to 23.

Differences between the method of manufacturing inductor 303 according to Embodiment 3 and the methods of manufacturing inductors 301 and 302 according to Embodiments 1 and 2 will be described below.

First, in the metal plate processing step, conductive plates 34 and 35 are prepared in addition to conductive plates 31, 32, and 33, as illustrated in FIG. 21. Main surface 42 of conductive plate 32 and main surface 44 of conductive plate 34 are formed in a single plane. Back surface 52 of conductive plate 32 and back surface 54 of conductive plate 34 are formed in a single plane. Main surface 43 of conductive plate 33 and main surface 45 of conductive plate 35 are formed in a single plane. Back surface 53 of conductive plate 33 and back surface 55 of conductive plate 35 are formed in a single plane. Each of main surfaces 41 to 45 connected at connecting locations 172 to 175 constitutes a portion of main surface 20A of metal plate 20, and each of back surfaces 51 to 55 connected at connecting locations 172 to 175 constitutes a portion of back surface 20B of metal plate 20.

Next, in the protrusion forming step, a pair of protrusions 94 protruding from back surface 54 and a pair of recesses 104 provided in main surface 44 of conductive plate 34 opposite to the pair of protrusions 94 are further formed at the pair of end parts 64 of conductive plate 34, as illustrated in FIG. 21.

A pair of protrusions 95 protruding from main surface 45 and a pair of recesses 105 provided in back surface 55 are formed in the pair of end parts 65 of conductive plate 35 opposite to the pair of protrusions 95 are formed at the pair of end parts 65 of conductive plate 35.

Protrusions 94 and 95 and recesses 104 and 105 are formed by press-working metal plate 20.

Protrusions 94 and 95 are formed so as to extend straight and slenderly in width direction 202 of end parts 64 and 65 to have a length that is equal to or longer than a half of the width dimension of end parts 64 and 65 and shorter than recesses 102 and 103.

The tip ends of protrusions 94 and 95 and the bottoms of recesses 104 and 105 have curved shapes.

Curvature RB of the curved shape of the bottoms of recesses 102 and 103 is greater than curvature RT of the curved shape of the tip ends of protrusions 94 and 95. In addition, depth DB of recesses 102 and 103 is less than protruding height HT of protrusions 94 and 95. This configuration allows the tip ends of protrusions 94 and 95 to enter into recesses 102 and 103, respectively.

Next, in the metal plate bending step, as illustrated in FIG. 22, main body 22 is further bent at connecting location 174 at which central part 72 is connected to central part 74 such that back surface 52 faces back surface 54 away from back surface 54 with a space in between.

Main body 22 is bent at connecting location 175 at which the central part 73 is connected to central part 75 such that main surface 43 faces main surface 45 away from main surface 45 with a space in between.

In this step, the tip ends of protrusions 94 are fitted into recesses 102, and the tip ends of protrusions 95 are fitted into recesses 103.

Next, in the weld-joining step, end parts 64 and 65 are sandwiched between a pair of welding electrodes 112 to resistance-weld end parts 61, 62, 63, 64, and 65 together, as illustrated in FIG. 23, thereby forming joint locations 81, 82, 83, and 84 at which end parts 61, 62, and 63 are welded to the tip ends of protrusion 92, 93, 94, and 95, as shown in FIG. 19.

In joint locations 83 and 84, the tip ends of protrusions 94 and 95 are welded to the bottoms inside recesses 102 and 103. This configuration facilitates arranging the pair of joint locations 81, the pair of joint locations 82, the pair of joint locations 83, and the pair of joint locations 84 to overlap each other when main body 22 is viewed from main surface 44 of conductive plate 34.

Here, joint locations 81, 82, 83, and 84 may be resistance-welded together separately at two different timings, one for joint locations 81 and 83 and the other for joint locations 82 and 84. In this case, one of the pair of welding electrodes 112 may contact electrode part 24 or lead-out part 23, and another of the welding electrodes 112 may contact end part 64 to weld joint locations 81 and 83. After that, the one of the pair of welding electrodes 112 may contact electrode part 24 or lead-out part 23, and another of the welding electrodes 112 may contact end part 65 to weld joint locations 82 and 84.

This configuration facilitates the welding of joint locations 81, 82, 83, and 84.

In the method of manufacturing inductor 303 according to Embodiment 3, before the metal plate bending step, an insulator forming step of forming insulator 25 made of insulating material on a portion in which central part 72 faces central part 74 and in a portion at which central part 73 faces central part 75 may be performed.

The insulator forming step may be performed either before or after the metal plate processing step, and may be performed with the materials and formation methods for insulator 25 that have been described in Embodiment 1.

In inductor 303 according to Embodiment 3, main body 22 further includes conductive plate 34 having main surface 44 and back surface 54 opposite to main surface 44 and conductive plate 35 having main surface 45 and back surface 55 opposite to main surface 45 in addition to Embodiments 1 and 2. Conductive plate 34 includes central part 74 connected to central part 72 at connecting location 174, and the pair of end parts 64 sandwiching central part 74 between the end parts. Main surface 44 and back surface 54 extend from central part 74 to the pair of end parts 64. Main body 22 is bent at connecting location 174 such that back surface 52 faces back surface 54 away from back surface 54 with a space in between, so that central part 72 is connected to central part 74 at connecting location 174. The pair of end parts 62 and the pair of end parts 64 share the pair of joint locations 83 at which the pair of end parts 62 are welded to the pair of end parts 64, respectively. In other words, one of the pair of end parts 62 is welded and joined to one of the pair of end parts 64 at one of the pair of joint locations 83 while another of the pair of end parts 62 is welded and joined to another of the pair of end parts 64 at another of the pair of joint locations 83. Conductive plate 34 includes the pair of protrusions 94 protruding from back surface 54 and the pair of recesses 104 provided in main surface 44 at the pair of end parts 64. The pair of end parts 62 are welded to the pair of protrusions 94, respectively. Conductive plate 35 includes central part 75 connected to central part 73 at connecting location 175, and the pair of end parts 65 sandwiching central part 75 between the end parts. Main surface 45 and back surface 55 extend from central part 75 to the pair of end parts 65. Similarly to central part 73 and central part 75, main body 22 is bent at connecting location 175 such that main surface 43 faces main surface 45 away from main surface 45 with a space in between so that central part 73 is connected to central part 75 at connecting location 175. The pair of end parts 63 and the pair of end parts 65 share the pair of joint locations 84 at which the pair of end parts 63 are welded to the pair of end parts 65, respectively. One of the pair of end parts 63 and one of the pair of end parts 65 are welded to each other to form one of the pair of joint locations 84, and the other one of the end parts 63 and the other one of the end parts 65 are welded to each other to form another of the joint locations 84. Conductive plate 35 includes the pair of protrusions 95 protruding from main surface 45 and the pair of recesses 105 provided in back surface 55 at the pair of end parts 65. The pair of end parts 63 are welded to the pair of protrusions 95, respectively.

Insulator 25 (252) made of insulative material may be disposed between central part 72 and central part 74 while insulator 25 (251) made of insulative material may be disposed between central part 73 and central part 75. Insulator 251 is formed over main surfaces 41 to 45 of conductive plates 31 to 35 of central parts 71 to 75. Insulator 252 is formed over back surfaces 51 to 55 of conductive plates 31 to 35 of central parts 71 to 75.

When main body 22 is viewed from main surface 44 of conductive plate 34, the pair of joint locations 81, the pair of joint locations 82, the pair of joint locations 83, and the pair of joint locations 84 preferably overlap each other.

In the pair of joint locations 83, the pair of protrusions 94 are preferably welded into the pair of recesses 102, respectively. In the pair of joint locations 84, the pair of protrusions 95 are preferably welded into the pair of recesses 103, respectively.

Each of protrusions 91, 92, 93, 94, and 95 described in Embodiments 1 to 3 extends straight and slenderly. Each of protrusions 91, 92, 93, 94, and 95 may have other shapes, such as a hemispherical shape or a truncated-conical shape. In this case, plural hemispherical protrusions 92 extending in width direction 202 may be formed in end part 62.

As described above, conductor 21 includes main body 22 embedded in exterior member 10, a pair of lead-out parts 23 connected to main body 22, and a pair of electrode parts 24 coupled to main body 22 and disposed outside exterior member 10. Main body 22 includes conductive plate 31 having main surface 41 and back surface 51 opposite to main surface 41, and conductive plate 32 having main surface 42 and back surface 52 opposite to main surface 42. Conductive plate 31 includes a pair of end parts 61 connected to the pair of electrode parts 24, respectively, and central part 71 sandwiched between the pair of end parts 61 in longitudinal direction 201. Main surface 41 and back surface 51 extend from central part 71 to the pair of end parts 61. Conductive plate 32 includes central part 72 connected to central part 71 at connecting location 172, and a pair of end parts 62 sandwiching central part 72 between the end parts in longitudinal direction 201. Main surface 42 and back surface 52 extend from central part 72 to the pair of end parts 62. Main body 22 is bent at connecting location 172 such that main surface 41 faces main surface 42 away from main surface 42 with a space in between. The pair of end parts 61 and the pair of end parts 62 are connected to each other at a pair of joint locations 81, respectively.

Conductive plate 32 further includes a pair of protrusions 92 protruding from main surface 42 at the pair of end parts 62. The pair of end parts 61 are joined to the pair of protrusions 92, respectively.

Insulator 251 made of insulative material is disposed between central part 71 and central part 72.

Main body 22 further includes conductive plate 33 having main surface 43 and back surface 53 opposite to main surface 43. Conductive plate 33 includes central part 73 connected to central part 71 at connecting location 173, and a pair of end parts 63 sandwiching central part 73 between the end parts in longitudinal direction 201. Main surface 43 and back surface 53 extend from central part 73 to the pair of end parts 63. Main body 22 is bent at connecting location 173 such that back surface 51 faces back surface 53 away from back surface 53 with a space in between. The pair of end parts 61 and the pair of end parts 63 are connected to each other at a pair of joint locations 82, respectively. Conductive plate 33 includes the pair of protrusions 93 protruding from back surface 53 in the pair of end parts 63, respectively. The pair of end parts 61 are joined to the pair of protrusions 93, respectively.

Insulator 251 made of insulative material is disposed between central part 71 and central part 72. Insulator 252 made of insulative material is disposed between central part 71 and central part 73.

When main body 22 is viewed from back surface 52 of conductive plate 32, that is, when viewed in direction 203 perpendicular to back surface 52, one of the pair of joint locations 81 overlaps one of the pair of joint locations 82, and another of the pair of joint locations 81 overlaps another of the pair of joint locations 82.

Main body 22 further includes conductive plate 34 having main surface 44 and back surface 54 opposite to main surface 44, and conductive plate 35 having main surface 45 and back surface 55 opposite to main surface 45. Conductive plate 34 includes central part 74 connected to central part 72 at connecting location 174, and a pair of end parts 64 sandwiching central part 74 between the end parts in longitudinal direction 201. Main surface 44 and back surface 54 extend from central part 74 to the pair of end parts 64. Main body 22 is bent at connecting location 174 such that back surface 52 faces back surface 54 away from back surface 54 with a space in between. The pair of end parts 62 and the pair of end parts 64 are connected to each other at a pair of joint locations 83, respectively. Conductive plate 34 further includes a pair of protrusions 94 protruding from back surface 54 at the pair of end parts 64. The pair of end parts 62 are joined to the pair of protrusions 94, respectively. Conductive plate 35 includes central part 75 connected to central part 73 at connecting location 175, and a pair of end parts 65 sandwiching central part 75 between the end parts in longitudinal direction 201. Main surface 45 and back surface 55 extend from central part 75 to the pair of end parts 65. Main body 22 is bent at connecting location 175 such that main surface 43 faces main surface 45 away from main surface 45 with a space in between. The pair of end parts 63 are connected to the pair of end parts 65 at a pair of joint locations 84, respectively. Conductive plate 35 further includes a pair of protrusions 95 protruding from main surface 45 at the pair of end parts 65. The pair of end parts 63 are joined to the pair of protrusions 95, respectively.

Insulator 252 made of insulative material is disposed between central part 72 and central part 74. Insulator 251 made of insulative material is disposed between central part 73 and central part 75.

One of the pair of joint locations 81, one of the pair of joint locations 82, one of the pair of joint locations 83, and one of the pair of joint locations 84 overlap each other when viewed from main surface 41 of conductive plate 31 of main body 22, that is, when viewed in direction 203 perpendicular to main surface 41. Another of the pair of joint locations 81, another of the pair of joint locations 82, another of the pair of joint locations 83, and another of the pair of joint locations 84 overlap each other when viewed in direction 203 that is perpendicular to main surface 41.

The pair of end parts 62 of conductive plate 32 have a pair of recesses 102 provided in back surface 52 of conductive plate 32, respectively. The pair of end parts 63 of conductive plate 33 have a pair of recesses 103 provided in back surface 53 of conductive plate 33, respectively. The pair of protrusions 94 are joined into the pair of recesses 102 in the pair of end parts 63, respectively. The pair of protrusions 95 are joined into the pair of recesses 103 in the pair of end parts 64, respectively.

Conductive plate 31 further includes a pair of protrusions 91 protruding from main surface 41 at the pair of end parts 61. The pair of end parts 62 are joined to the pair of protrusions 91, respectively.

The pair of lead-out parts 23 are embedded in exterior member 10.

REFERENCE MARKS IN THE DRAWINGS

10 exterior member
11 bottom surface
12 top surface
13 side surface
14 side surface
15 side surface
16 side surface
20 metal plate
21 conductor
22 main body
23 lead-out part
24 electrode part
25, 251, 252 insulator
31 conductive plate (first conductive plate)
32 conductive plate (second conductive plate)
33 conductive plate (third conductive plate)
34 conductive plate (fourth conductive plate)
35 conductive plate (fifth conductive plate)
41 main surface (first main surface)
42 main surface (second main surface)
43 main surface (third main surface)
44 main surface (fourth main surface)
45 main surface (fifth main surface)
51 back surface (first back surface)
52 back surface (second back surface)
53 back surface (third back surface)
54 back surface (fourth back surface)
55 back surface (fifth back surface)
61 end part (first end part)
62 end part (second end part)
63 end part (third end part)
64 end part (fourth end part)
65 end part (fifth end part)
71 central part (first central part)
72 central part (second central part)
73 central part (third central part)
74 central part (fourth central part)
75 central part (fifth central part)
81 joint location (first joint location)
82 joint location (second joint location)
83 joint location (third joint location)
84 joint location (fourth joint location)
91 protrusion
92 protrusion (first protrusion)
93 protrusion (second protrusion)
94 protrusion (third protrusion)
95 protrusion (fourth protrusion)
101 recess
102 recess (first recess)
103 recess (second recess)
104 recess
105 recess
111 cavity
112 welding electrode
172 connecting location (first connecting location)
173 connecting location (second connecting location)
174 connecting location (third connecting location)
175 connecting location (fourth connecting location)
301 inductor
302 inductor
303 inductor

The invention claimed is:

1. An inductor comprising:

a conductor made of conductive material; and an exterior member containing magnetic material, wherein the conductor includes:

a main body embedded in the exterior member;

a pair of lead-out parts connected to the main body; and a pair of electrode parts coupled to the main body and disposed outside the exterior member, the main body includes:

a first conductive plate having a first main surface and a first back surface opposite to the first main surface; and a second conductive plate having a second main surface and a second back surface opposite to the second main surface, the first conductive plate includes:

a pair of first end parts connected to the pair of electrode parts, respectively; and a first central part sandwiched between the pair of first end parts in a longitudinal direction;

the first main surface and the first back surface extend from the first central part to the pair of first end parts, the second conductive plate includes:

a second central part connected to the first central part at a first connecting location; and a pair of second end parts sandwiching the second central part therebetween in the longitudinal direction, the second main surface and the second back surface extend from the second central part to the pair of second end parts, the main body is bent at the first connecting location such that the first main surface faces the second main surface away from the second main surface with a space in between, and the pair of first end parts are joined to the pair of second end parts at a pair of first joint locations, respectively.

2. The inductor of claim 1, wherein the second conductive plate further includes a pair of first protrusions protruding from the second main surface, the pair of first protrusions being disposed at the pair of second end parts, respectively, and the pair of first end parts are joined to the pair of first protrusions, respectively.

3. The inductor of claim 2, further comprising an insulator made of insulative material disposed between the first central part and the second central part.

4. The inductor of claim 2, wherein the main body further includes a third conductive plate having a third main surface and a third back surface opposite to the third main surface, the third conductive plate includes:

a third central part connected to the first central part at a second connecting location; and a pair of third end parts sandwiching the third central part therebetween in the longitudinal direction, the third main surface and the third back surface extend from the third central part to the pair of third end parts, the main body is bent at the second connecting location such that the first back surface faces the third back surface away from the third back surface with a space in between, the pair of first end parts are joined to the pair of third end parts at a pair of second joint locations, respectively, the third conductive plate includes a pair of second protrusions protruding from the third back surface, the pair of second protrusions disposed in the pair of third end parts, respectively, and the pair of first end parts are joined to the pair of second protrusions, respectively.

5. The inductor of claim 4, further comprising:

a first insulator made of insulative material disposed between the first central part and the second central part, and a second insulator made of insulative material disposed between the first central part and the third central part.

6. The inductor of claim 4, wherein, when the main body is viewed from the second back surface of the second conductive plate, one of the pair of first joint locations overlaps one of the pair of second joint locations, and another of the pair of the first joint locations overlaps another of the pair of second joint location.

7. The inductor of claim 4, wherein the main body further includes:

a fourth conductive plate having a fourth main surface and a fourth back surface opposite to the fourth main surface; and a fifth conductive plate having a fifth main surface and a fifth back surface opposite to the fifth main surface, the fourth conductive plate includes:

a fourth central part connected to the second central part at a third connecting location; and a pair of fourth end parts sandwiching the fourth central part therebetween in the longitudinal direction, the fourth main surface and the fourth back surface extend from the fourth central part to the pair of fourth end parts, the main body is bent at the third connecting location such that the second back surface faces the fourth back surface away from the fourth back surface with a space in between, the pair of second end parts are joined to the pair of fourth end parts at a pair of third joint locations, respectively, the fourth conductive plate further includes a pair of third protrusions protruding from the fourth back surface, the pair of third protrusions being disposed at the pair of fourth end parts, respectively, the pair of second end parts are joined to the pair of third protrusions, respectively, the fifth conductive plate includes:

a fifth central part connected to the third central part at a fourth connecting location; and a pair of fifth end parts sandwiching the fifth central part therebetween in the longitudinal direction, the fifth main surface and the fifth back surface extend from the fifth central part to the pair of fifth end parts, the main body is bent at the fourth connecting location such that the third main surface faces the fifth main surface away from the fifth main surface with a space in between, the pair of third end parts are joined to the pair of fifth end parts at a pair of fourth joint locations, respectively, the fifth conductive plate further includes a pair of fourth protrusions protruding from the fifth main surface, the pair of fourth protrusions being disposed at the pair of fifth end parts, respectively, and the pair of third end parts are joined to the pair of fourth protrusions, respectively.

8. The inductor of claim 7, further comprising:

a first insulator made of insulative material disposed between the first central part and the second central part;

a second insulator made of insulative material disposed between the first central part and the third central part;

a third insulator made of insulative material disposed between the second central part and the fourth central part; and a fourth insulator made of insulative material disposed between the third central part and the fifth central part.

9. The inductor of claim 7, wherein:

when viewed in a direction perpendicular to the first main surface of the first conductive plate of the main body, one of the pair of first joint locations, one of the pair of second joint locations, one of the pair of third joint locations, and one of the pair of fourth joint locations overlap each other, and when viewed in the direction perpendicular to the first main surface, another of the pair of first joint locations, another of the pair of second joint locations, another of the pair of third joint locations, and another of the pair of fourth joint locations overlap each other.

10. The inductor of claim 7, wherein the pair of second end parts of the second conductive plate have a pair of first recesses provided in the second back surface of the second conductive plate, respectively, the pair of third end parts of the third conductive plate have a pair of second recesses provide in the third back surface of the third conductive plate, the pair of third protrusions are joined into the pair of first recesses in the pair of third end parts, respectively, and the pair of fourth protrusions are joined into the pair of second recesses in the pair of fourth end parts, respectively.

11. The inductor of claim 1, wherein:

the first conductive plate further includes a pair of protrusions protruding from the first main surface, the pair of protrusions being disposed at the pair of first end parts, and the pair of second end parts are joined to the pair of protrusions, respectively.

12. The inductor of claim 11, further comprising an insulator made of insulative material disposed between the first central part and the second central part.

13. The inductor of claim 1, wherein the pair of lead-out parts are embedded in the exterior member.

* * * * *